US006326094B1

(12) United States Patent
Asano et al.

(10) Patent No.: US 6,326,094 B1
(45) Date of Patent: Dec. 4, 2001

(54) FIBER STRUCTURE AND TEXTILE USING SAME

(75) Inventors: Makoto Asano, Yokohama; Toshimasa Kuroda, Osaka; Susumu Shimizu, Kanagawa; Akio Sakihara, Kanagawa; Kinya Kumazawa, Kanagawa; Hiroshi Tabata, Yokohama, all of (JP)

(73) Assignees: Nissan Motor Co., Ltd., Yokohama; Tanaka Kikinzoku Kogyo K.K., Tokyo; Teijin Limited, Osaka, all of (JP)

( * ) Notice: Subject to any disclaimer, the term of this patent is extended or adjusted under 35 U.S.C. 154(b) by 0 days.

(21) Appl. No.: 09/266,818

(22) Filed: Mar. 12, 1999

(51) Int. Cl.[7] ..... B41M 3/12
(52) U.S. Cl. ..... 428/913; 428/38; 428/542.6
(58) Field of Search ..... 428/225, 298, 428/373, 542.6, 690, 38, 36.3, 913, 202

(56) References Cited

U.S. PATENT DOCUMENTS

| | | | |
|---|---|---|---|
| 5,407,738 | 4/1995 | Tabata et al. | 428/229 |
| 5,472,798 | 12/1995 | Kumazawa et al. | 428/690 |
| 5,749,633 | 5/1998 | Baumgartner . | |

FOREIGN PATENT DOCUMENTS

| | | |
|---|---|---|
| 686 858 | 12/1995 | (EP) . |
| 0 767 260 | 4/1997 | (EP) . |
| 2 297 752 | 8/1996 | (GB) . |
| 43-14185 | 6/1968 | (JP) . |
| 59-228042 | 12/1984 | (JP) . |
| 60-24847 | 6/1985 | (JP) . |
| 62-170510 | 7/1987 | (JP) . |
| 63-120642 | 5/1988 | (JP) . |
| 63-64535 | 12/1988 | (JP) . |
| 1-139803 | 6/1989 | (JP) . |
| 6-101178 | 4/1994 | (JP) . |
| 7-42070 | 2/1995 | (JP) . |
| 7-195603 | 8/1995 | (JP) . |
| 9-133039 | 4/1997 | (JP) . |
| 78109170 | 11/1989 | (TW) . |
| 79106954 | 8/1990 | (TW) . |
| 83105282 | 6/1994 | (TW) . |
| 97/21855 | 6/1997 | (WO) . |

OTHER PUBLICATIONS

Patent Abstracts of Japan, Publication No. 07195603, Aug. 1, 1995, abstract of Tabata Hiroshi, "Structure reflecting one or both of near Ultraviolet rays and near infrared rays", EPO.

K. Matsumoto et al., "Studies on the Photo–Controllable Coloring Fibers Part 1: Photo–Controllable . . . by Optical Interference", J. Textile Mach. Soc., vol. 42:2, (1989), pp. 55–62, Engl. Abstract.

K. Matsumoto et al., "Studies on the Photo–Controllable Coloring Fibers Part 2: Hue Analysis of the . . . Coloring Film", J. Textile Mach. Sci., vol. 42:2, (1989), pp. 60–68, Engl. Abstract.

*Primary Examiner*—Merrick Dixon
(74) *Attorney, Agent, or Firm*—Foley & Lardner

(57) ABSTRACT

A fiber structure includes alternate lamination including a predetermined number of a first portion having a refractive index na and a thickness da, and a second portion adjacent to the first portion and having a refractive index nb and a thickness db, wherein when the refractive index na is given by $1.3 \leqq na$, and a ratio nb/na is given by $1.01 \leqq nb/na \leqq 1.20$, a reflection peak wavelength $\lambda$ is equal to 2(nada+nbdb). Such fiber structure is used in a textile.

10 Claims, 23 Drawing Sheets

FIBER STRUCTURE AND TEXTILE USING SAME

This application claims the benefit under 35 U.S.C. §§120 and 365(c) of International Application PCT/JP98/04397, which was filed on Sep. 30, 1998, and which designated the United States, The International Application was not published under PCT Article 21(2) in English.

The contents of Japanese Patent Applications P9-285776 and P9-270095 are hereby incorporated by reference.

TECHNICAL FIELD

The present invention relates to a fiber structure for producing a color by reflecting and interfering visible radiation or reflecting ultraviolet or infrared radiation, and a textile using such fiber structure.

BACKGROUND ART

Conventionally, paints with inorganic or organic dyes or pigments or bright materials such as aluminum flakes and mica have been used to give colors to various materials such as fiber, building material and coating material, or reflect therefrom ultraviolet and infrared rays, or achieve further improvement of visual quality and feeling thereof.

Recently, with user's diversified taste and tendency to higher quality, there are increasing demands on graceful and quality fiber structures which have color tones varying with the point of view and higher chromas. In such a situation, many attempts are carried out to obtain a fiber structure which produces a color relying upon no coloring matter such as dye or pigment, but physical phenomena such as optical reflection, interference, diffraction and scattering, and a fiber structure which produces a brighter color relying upon the synergistic effect of coloring due to a coloring matter and coloring due to physical phenomena.

By way of example, JP 43-14185 and JP-A 1-139803 disclose coated-type composite fibers with iridescence which are made of two or more resins having different optical refractive index. A journal of the Textile Machinery Society of Japan (Vol. 42, No. 2, pp. 55–62, published in 1989 and Vol. 42, No. 10, pp. 60–68, published in 1989) describes laminated photo-controllable polymer films for producing colors by optical interference, wherein a film with anisotropic molecular orientation is interposed between two polarizing films.

JP-A 59-228042, JP-B2 60-24847, and JP-B2 63-64535 disclose fabrics with iridescence conceived, e.g. from a South American morpho-butterfly which is well-known by its bright color tone varying with the point of view. JP-A 62-170510 and JP-A 63-120642 disclose structures which produce interference colors due to recesses with a predetermined width formed on the surface of the fibers. Both references describe that formed structures are fast and permanent in color due to no use of dyes and pigments.

However, the composite fibers as disclosed in JP 43-14185 and JP-A 1-139803 cannot produce transparent bright colors since the optical thickness (=thickness of a coating layer ×refractive index) is not always uniform, and the coloring region is not wide, but limited. The laminated photo-controllable polymer films as described in the journal of the Textile Machinery Society of Japan cannot produce colors with sufficient brightness, and are difficult to form in fine fibers or minute chips or fragments at a low manufacturing cost. The fabrics and structures as disclosed in JP-A 59-228042, JP-B2 60-24847, JP-B2 63-64535, JP-A 62-170510, and JP-A 63-120642 are practically very difficult to provide desired coloring effect.

For solving such inconveniences, U.S. Pat. No. 5,407,738 and U.S. Pat. No. 5,472,798 propose structures which produce bright and permanent colors having tones varying with the point of view by optical reflection and interference. The teachings of U.S. Pat. No. 5,472,798 are hereby incorporated by reference. Moreover, JP-A 7-195603 proposes a structure which reflects ultraviolet ray and/or infrared ray.

In order to manufacture a coloring structure having optical reflection and interference as disclosed, e.g. in U.S. Pat. No. 5,472,798, however, the number of combinable polymers is small which form alternate lamination and have the refractive-index ratio of 1.1 or more, causing a problem of less variety of combination. Further, despite a great advantage of a possible reduction in the number of layers for achieving higher reflectivity, the flowability of the combinable polymers is not always sufficient, which makes very difficult uniform and stable manufacturing of alternate lamination of films with small thickness (e.g. 0.08 $\mu$m) except part of the combinable polymers. Furthermore, the combinable polymers, which are not in general use, are high in cost.

It is, therefore, an object of the present invention to provide a fiber structure having reflection and interference of visible radiation or reflection of ultraviolet or infrared radiation, with easy manufacturing process and reduced manufacturing cost. Another object of the present invention is to provide a textile using such fiber structure.

DISCLOSURE OF THE INVENTION

One aspect of the present invention lies in providing a fiber structure having at least one of the characteristics of reflection and interference of visible radiation, reflection of ultraviolet radiation, and reflection of infrared radiation, the fiber structure having a cross section with X-axis and Y-axis directions, comprising:

- an alternate lamination arranged in the cross section, said alternate lamination including a predetermined number of:
  - a first portion having a refractive index na and a thickness da; and
  - a second portion adjacent to said first portion, said second portion having a refractive index nb and a thickness db, wherein when said refractive index na is given by $1.3 \leqq na$, and a ratio nb/na is given by $1.01 \leqq nb/na \leqq 1.20$, a reflection peak wavelength $\lambda$ is equal to 2(nada+nbdb).

Another aspect of the present invention lies in providing a textile, comprising:

- a first fiber, said first fiber including a fiber structure having a characteristic of reflection and interference of visible radiation; and
- a second fiber combined with said first fiber, said second fiber including one of a natural fiber, a chemical fiber and a mixed fiber of said natural and chemical fibers.

Still another aspect of the present invention lies in providing a textile, comprising:

- a warp; and
- a weft arranged to cross said warp,
  - said warp and weft each including a fiber structure having a characteristic of reflection and interference of visible radiation.

Still another aspect of the present invention lies in providing a textile, comprising:

- a warp; and
- a weft arranged to cross said warp,
  - one of said warp and weft including a fiber structure having a characteristic of reflection and interference of visible radiation, another of said warp and weft including a white fiber.

A further aspect of the present invention lies in providing a textile, comprising:

an embroidery arranged in a predetermined portion of the textile, said embroidery being formed with a fiber structure having a characteristic of reflection and interference of visible radiation.

BEST MODE FOR CARRYING OUT THE INVENTION

Figure 1A:
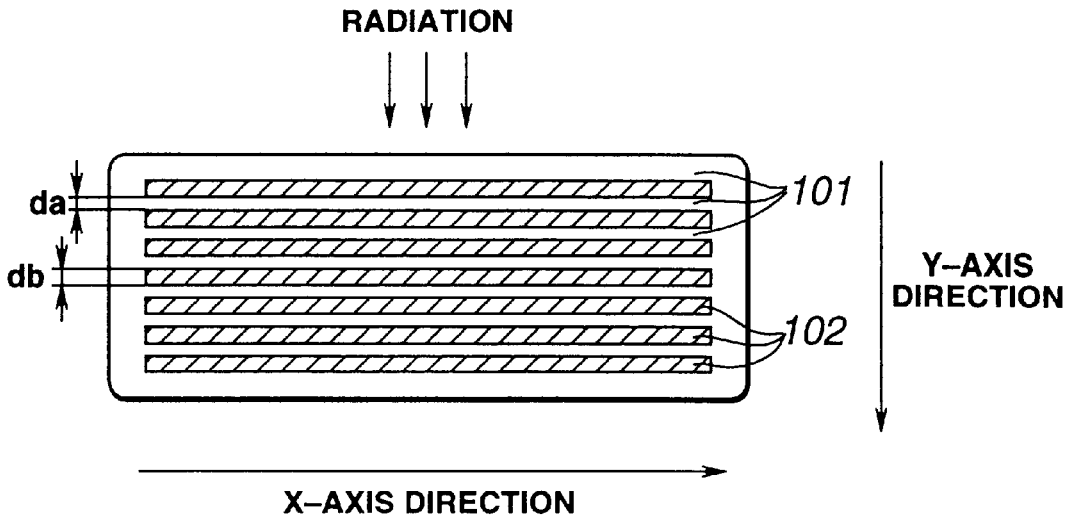
FIGS. 1A–1B are cross sections, each showing a fiber structure embodying the present invention.

Referring to the drawings, a fiber structure embodying the present invention will be described.

Referring first to FIG. 1A, a fiber structure with an axis extending in one-axis or Z-axis direction includes in a cross section a first organic polymer layer or film 101 and a second organic polymer layer or film 102 having different refractive index. The first and second organic polymer layers 101, 102 extend continuously in the X-axis direction of the fiber structure, and are laminated in the Y-axis direction thereof.

Figure 1B:
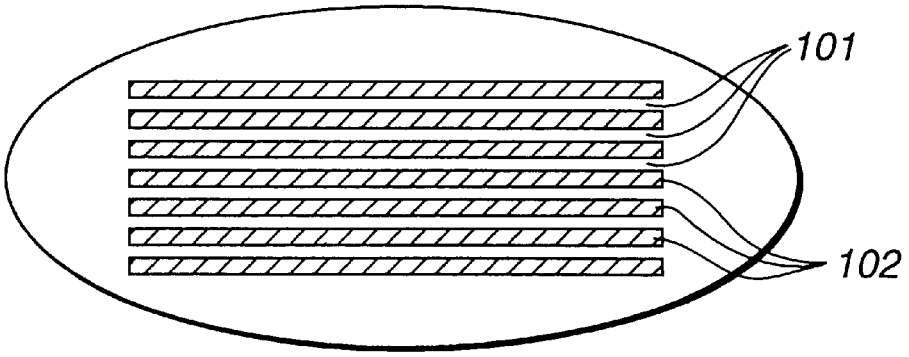
Figure 2A:
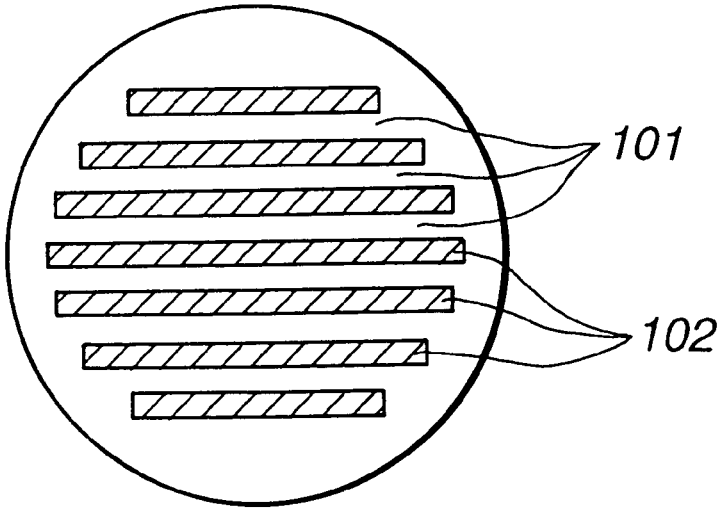
FIGS. 2A–2B are views similar to FIG. 1B, each showing another fiber structure.
Figure 2B:
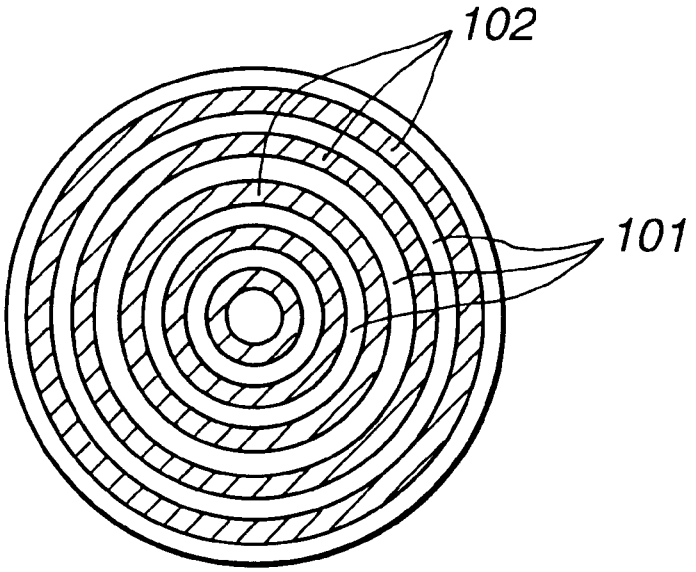

The section of the fiber structure may be rectangular as shown in FIG. 1A, or oval as shown in FIG. 1B, or circular as shown in FIG. 2A. Regarding the fiber structure with circular section, the first and second organic polymer layers 101, 102 may be laminated concentrically as shown in FIG. 2B. Moreover, the section of the fiber structure may be shaped like a star or a polygon. However, the section of the fiber structure is, preferably, in a flat shape in view of its wider reflecting and interfering area in the X-axis direction. The flattening ratio or ratio of the length of the fiber structure in the X-axis direction to the length thereof in the Y-axis direction is, preferably, between 1.5 and 10.0. With the flattening ratio of 15.0 or more, the fiber structure has greatly deteriorated spinnability.

Figure 3A:
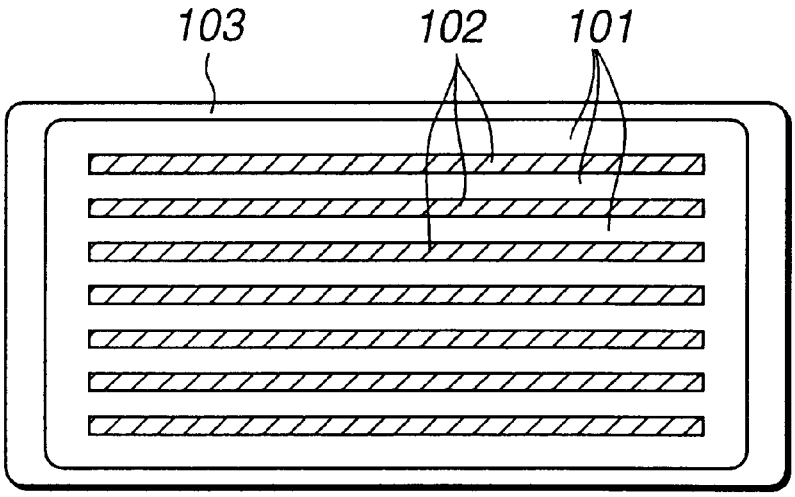
FIGS. 3A–3B are views similar to FIG. 2B, each showing still another fiber structure.
Figure 3B:
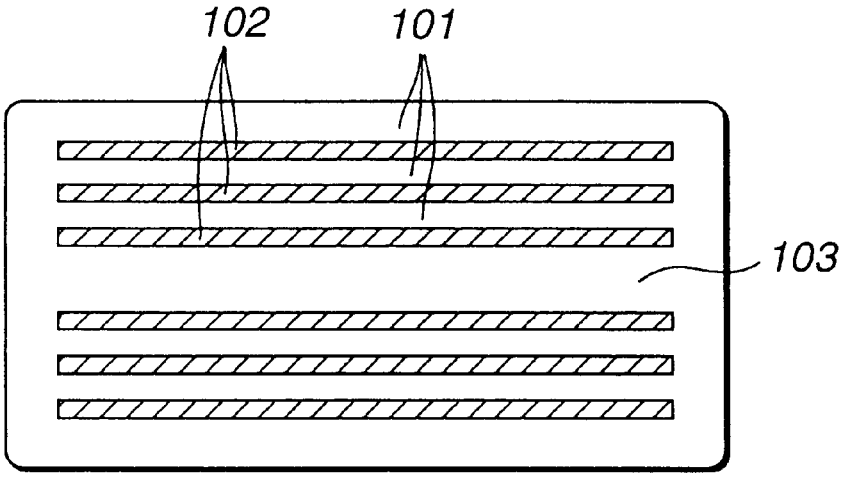
Figure 4A:
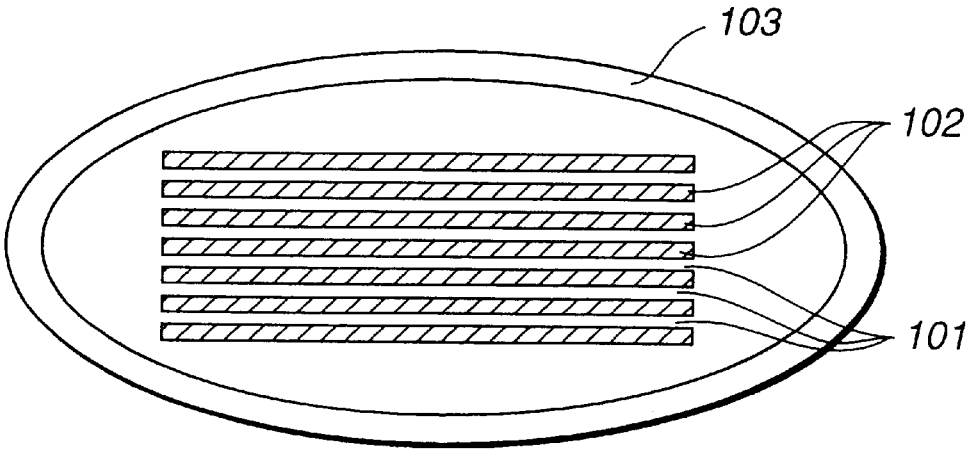
FIGS. 4A–4C are views similar to FIG. 3B, each showing still another fiber structure.
Figure 4B:
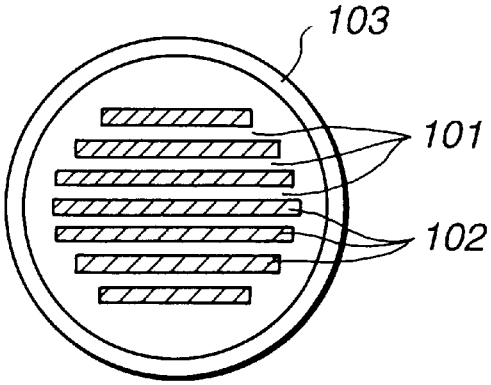
Figure 4C:
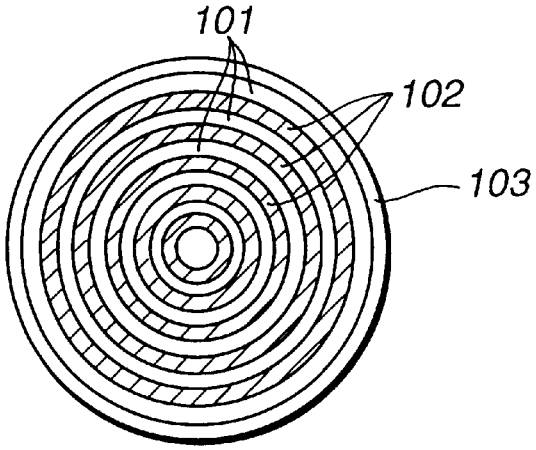

Referring to FIGS. 3A–4C, the fiber structure may include a protective layer 103 arranged around alternate lamination of the first and second organic polymer layers 101, 102 as shown in FIGS. 3A and 4A–4C or in the middle thereof as shown in FIG. 3B to prevent breakaway of the two and improve the wear resistance and the mechanical strength.

Figure 5A:
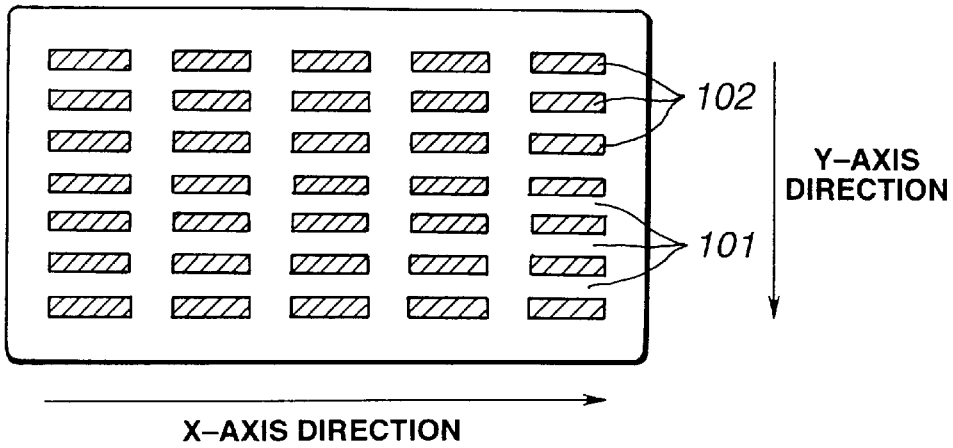
FIGS. 5A–5B are views similar to FIG. 4C, each showing other fiber structure.
Figure 5B:
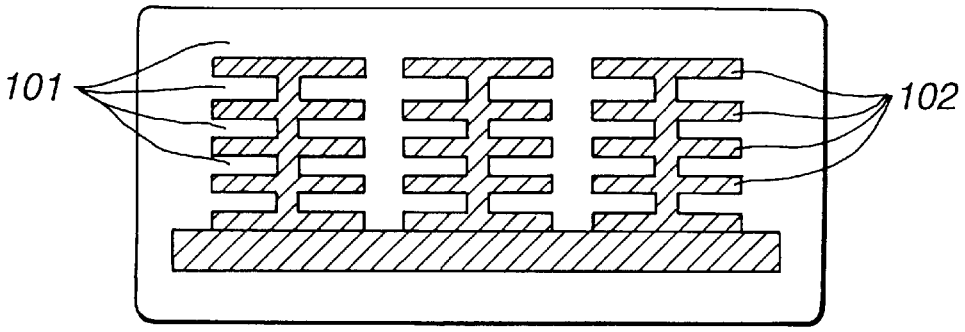

Referring to FIG. 5A, the second organic polymer layer 102 may extend discontinuously or have portions interrupted by the first organic polymer layer 101 in the X-axis direction. Moreover, referring to FIG. 5B, the second organic polymer layers 102 may be connected by a midrib to form a lamellar ridge structure as shown, e.g. in U.S. Pat. No. 5,407,738.

The first and second organic polymer layers 101, 102 may extend continuously or discontinuously in the X-axis direction so long as they are laminated regularly in the Y-axis direction. In the latter case, the length of a side of the fiber structure in the Xaxis direction is, preferably, greater than the wavelength of reflected radiation.

The number N of laminations of the first and second organic polymer layers 101, 102 is, preferably, 5 or more, and particularly, between 10 and 120. With the number N of laminations of less than 5, a ratio nb/na of a refractive index nb of the second organic polymer to a refractive index na of the first organic polymer is given by $1.01 \leqq nb/na \leqq 1.20$, which cannot ensure great optical reflection and interference. With the number N of laminations of more than 120, the structure of a spinneret becomes complicated, which makes polymer flow therein different from laminar flow, resulting in impossible achievement of uniform and stable alternate lamination.

The fiber structure according to the present invention has fundamentally a layer structure including alternate lamination of layers of two organic polymers having different refractive index. The organic polymers are, preferably, high polymer resins, particularly, thermoplastic polymer resins, with a certain translucency. Particularly, a fiber structure which produces a color by reflecting and interfering visible radiation (0.38–0.78 $\mu$m) has, preferably, higher translucency with respect to visible radiation.

Specifically, referring to FIG. 1A, alternate lamination is a structure including the first organic polymer layer 101 with a predetermined thickness and the second organic polymer layer 102 with a predetermined thickness arranged regularly alternately in the Y-axis direction and having a predetermined length in the X-axis direction. Note that vertical incidence of radiation means that radiation is incident on alternate lamination of the first and second organic polymer layers 101, 102 in the Y-axis direction.

The organic polymers include polyethylene terephthalate (PET), polybutylene terephthalate (PBT), and polyethylene naphthalate (PEN); and polyamides such as polyester, polyacrylonitrile, polystyrene (PS), polyvinylidene fluoride (PVDF), nylon-6 (Ny-6) and nylon-66 (Ny-66), polypropylene (PP), polyvinyl alcohol, polycarbonate (PC), polymethyl methacrylate (PMMA), polyether etherketone (PEEK), polyparaphenylene terephthal amide, polyphenylene sulfide (PPS), which are obtained by denaturing the above three by third components, respectively. Moreover, the organic polymers include mixtures of two or more of the above polymer resins, and copolymer resins thereof.

Study reveals the following fact. With a fiber structure which has an axis extending in one-axis or Z-axis direction and a cross section with X-axis and Y-axis directions and comprises an alternate lamination arranged in the cross section and including a first organic polymer layer 101 having a refractive index na and a thickness da, and a second organic polymer layer 102 adjacent thereto and having a refractive index nb and a thickness db, the object of the present invention is achieved if when $1.3 \leqq na$ and $1.0 \leqq nb/na \leqq 1.20$, a reflection peak wavelength $\lambda$ is equal to 2(nada+nbdb).

The above conditions will be described in detail. The condition given by $1.3 \leqq na$ results from the fact that the refractive index of the organic polymers is generally between 1.30 and 1.82, and practically, between 1.35 and 1.75, wherein 1.30 corresponds to a lower limit of the refractive index of organic polymers. The refractive index of the organic polymers can be reduced by adding therein, e.g. fluorine, which enables, theoretically, the refractive index of about 1.3. Note that the refractive index of the organic polymers varies with the degree of stretching, etc. Moreover, a reduction in the refractive index of the organic polymers can be obtained by adding therein particulates of a crystal with low refractive index such as sodium fluoride (NaF) or magnesium fluoride ($MgF_2$), which causes, however, turbidity of the organic polymers to reduce the translucency and/or deteriorates the formability thereof. The organic polymers with low refractive index (1.4 or less) include fluororesins such as polytetrafluoroethylene (PTFE) and fluoroetylene-polypropylene (FEP), and silicone resins such as polysiloxane. The organic polymers with high refractive index (1.6 or more) include polyester resins such as polyvinylidene chloride (PVDC) and polyethylene naphthalate (PEN), and polyphenyl sulfide (PPS).

When manufacturing minute articles by combining two or more of the above organic polymers, a forming-temperature difference $\Delta T$ between the two and a surface-energy difference $\Delta E$ therebetween constitute important factors. Particularly, the forming-temperature difference $\Delta T$ is very important in view of selection of organic polymers.

A description will be made with regard to the forming-temperature difference $\Delta T$ when using a combination of two organic polymers. The forming-temperature difference $\Delta T$ is a difference between a forming temperature T1 of the first organic polymer and a forming temperature T2 of the second organic polymer, i.e. $|T2-T1|$. Generally, it is desirable that the forming-temperature difference $\Delta T$ is small, i.e. about 80° C. or less, and preferably, about 60–50° C. or less. The reason is as follows:

First, when carrying out composite forming or spinning with greater $\Delta T$, the temperature of the organic polymer with lower forming temperature should be increased up to the temperature of the organic polymer with higher forming temperature. Thus, the organic polymer with lower forming temperature undergoes higher temperature to cause a reduction in molecular weight or easy thermal decomposition, which deteriorates physical properties including mechanical and optical characteristics, resulting in impossible practical use. In the composite spinning process, particularly, an improvement of the orientation and crystallization cannot be obtained by heat stretching after spinning, resulting in difficult achievement of sufficient tensile strength and ductility in practical use.

Second, when $\Delta T$ is greater, the melt-viscosity difference between the two organic polymers is greater. Thus, confluence and distribution of the two organic polymers in a spinneret or a dye do not always conform with the design, resulting in difficult manufacturing of desired minute articles. Generally, when the melt-viscosity difference is greater, distribution is controlled by the discharge in accordance with the Hagen-Poiseuille's equation. Particularly, when manufacturing a fiber structure having optical reflection and interference, the first and second organic polymer layer 101, 102 should be very small in thickness (approximately 0.07–0.08 $\mu$m), and be formed uniformly in view of coloring in the visible region. This justifies adoption of the smallest forming-temperature difference $\Delta T$.

Figure 6:
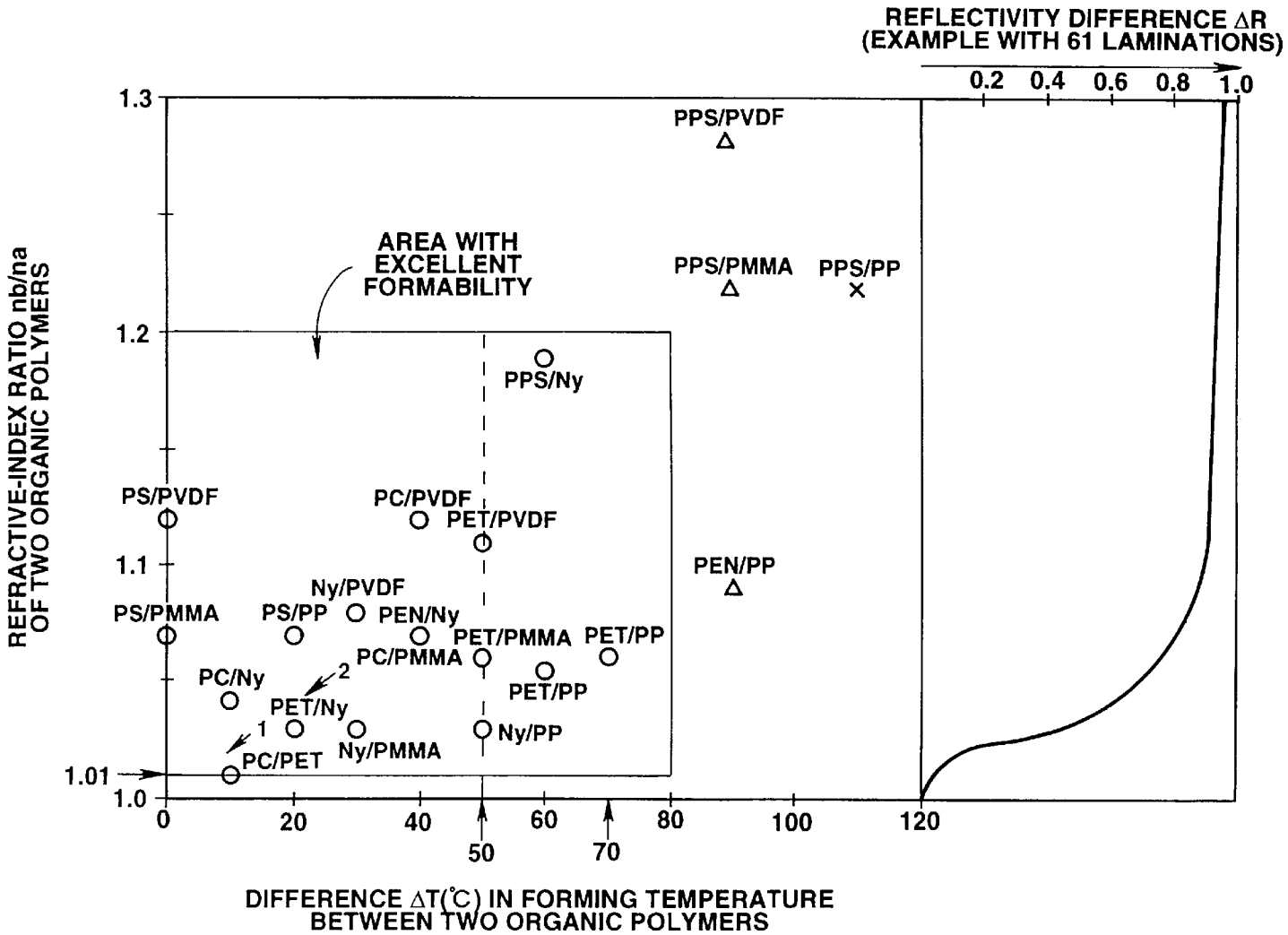
FIG. 6 is a graphical representation showing a relationship between a forming-temperature difference and a refractive-index ratio for combinations of two organic polymers.

The formula of $1.01 \leqq nb/na \leqq 1.20$ gives lower and upper limits of the ratio nb/na of the refractive index nb of the second organic polymer 102 and the refractive index na of the first organic polymer 101. The condition given by $1.01 \leqq nb/na \leqq 1.20$ is important in view of the following fact:

FIG. 6 shows a relationship between the forming-temperature difference $\Delta T$ and the refractive-index ratio nb/na for combinations of two organic polymers having translucency. Note that in FIG. 6, a circle (○) designates excellent formability, and a triangle (Δ) designates mediocre formability, and a cross (X) designates bad formability. FIG. 6 reveals that great part of the combinations of two organic polymers having the forming-temperature difference $\Delta T$ of 80–70° C. or less have relatively excellent formability, and refractive-index ratio nb/na ranging from 1.01 to 1.20. Moreover, FIG. 6 gives an important result that great part of the combinations of two organic polymers having the preferable forming-temperature difference $\Delta T$ of 60–50° C. or less have refractive-index ratio nb/na ranging from 1.01 to 1.10.

Referring to FIG. 6, the condition given by $1.01 \leqq nb/na$ will be described in detail. Take as example a combination of polycarbonate (PC) and polyethylene terephthalate (PET). The forming temperature T1 of PET is 290° C., whereas the forming temperature T2 of PC is about 280° C. Thus, the forming-temperature difference $\Delta T$ between the two is about 10° C. The refractive-index ratio nb/na of PC and PET is 1.01. Therefore, referring to FIG. 6, the combination of PC and PET is in a lower left position as indicated by arrow 1. When manufacturing a fiber structure as shown in FIG. 3A and having the number N of laminations of, e.g. 61 out of the combination of PC and PET, the fiber has a reflectivity difference $\Delta R$ of about 0.1 as shown in FIG. 6, which will be described later in detail in connection with FIGS. 7–13.

Recent study reveals that the relative reflectivity obtained by experiments (incident angle of 0° and receiving angle of 0°) is 2–2.5 times as large as the reflectivity difference $\Delta R$ obtained by calculation. A conversion based on this knowledge gives a relative reflectivity of about 0.20–0.25, which corresponds to a level for enabling visual color recognition, i.e. a lower limit. If the refractive index ratio nb/na is smaller than 1.01, the reflectivity difference $\Delta R$ is reduced to disable visual color recognition.

Moreover, if the refractive-index ratio nb/na falls below 1.01 and approaches 1.0, the fiber structure is apt to be influenced by fluctuation of the refractive index due to the temperature, dispersion of the refractive index in accordance with the wavelength, etc., resulting in difficult achievement of practically satisfactory optical reflection and interference even with largely increased number N of laminations. It will be thus understood that the condition given by $1.01 \leqq nb/na$ is indispensable to give a lower limit of the refractive-index ratio nb/na.

Next, referring to FIG. 6, the condition given by $nb/na \leqq 1.20$ will be described in detail. Take as an example a combination of polyphenylene sulfide (PPS) and polypropylene (PP). The refractive-index ratio nb/na of PP and PPS is 1.22, which is a rather high value in the refractive-index ratios of the combinations of two organic polymers. Referring to FIG. 6, the reflectivity difference ΔR of this combination is about 0.9. On the other hand, regarding the forming temperature which constitutes an important factor when combining two organic polymers, the forming temperature T1 of PP is 220° C., whereas the forming temperature T2 of PPS is about 330° C. Thus, the forming-temperature difference ΔT between the two is about 110° C., resulting in bad formability in composite spinning and forming. Unfortunately, study reveals that there is no combination of two organic polymers having the refractive-index ratio nb/na of 1.20 or more and the forming-temperature difference ΔT of 80–70° C. or less, preferably, 60–50° C. or less. It will be thus understood that the condition given by nb/na≦1.20 is indispensable to give an upper limit of the refractive-index ratio nb/na. In view of the forming-temperature difference ΔT, the preferable refractive-index ratio nb/na is given by 1.03≦nb/na≦1.10.

Take as another example a combination of polyethylene terephthalate (PET) and nylon-6 (Ny-6) which are typical synthetic resins. The forming temperature T1 of PET is about 290° C., whereas the forming temperature T2 of Ny-6 is about 270° C. Thus, the forming-temperature difference ΔT between the two is about 20° C. The refractive-index ratio nb/na of PET and Ny-6 is about 1.03. Referring to FIG. 6, the combination of PET and Ny-6 is in a lower left position as indicated by arrow 2. When manufacturing a fiber structure as shown in FIG. 3A and having the number N of laminations of, e.g. 61 out of the combination of PET and Ny-6, the fiber has a reflectivity difference ΔR of about 0.35 as shown in FIG. 6. A conversion based on this knowledge gives a relative reflectivity of about 0.70–0.87, which corresponds to a level for enabling distinct visual color recognition.

FIGS. 7–13 show a first embodiment of the present invention wherein with a fiber structure as shown in FIG. 3A, the reflection spectrum in the visible region is given by varying the refractive-index ratio nb/na of two organic polymers from 1.005 to 1.20. Here, the number N of laminations of the first and second organic polymer layers 101, 102 is 61, and the protective layer 103 has a refractive index of 1.53 and a thickness of 5 μm. The reflection peak wavelength λ is 0.47 μm (blue). Radiation is incident on the fiber structure vertically, i.e. at the incident angle of 0° and the receiving angle of 0°.

Figure 7:
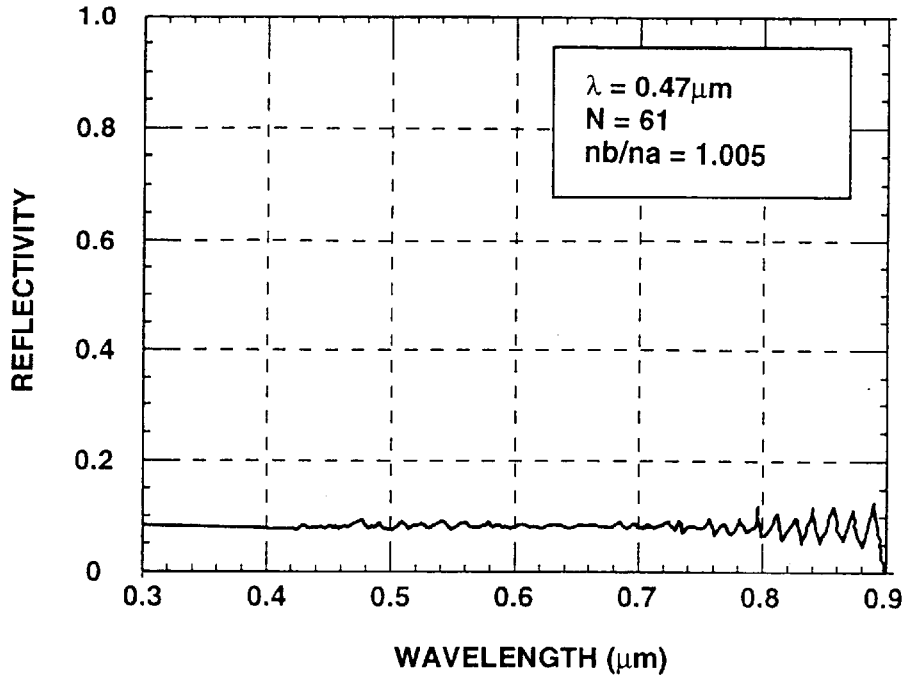
FIGS. 7–13 are graphs showing a first embodiment of the present invention.
Figure 8:
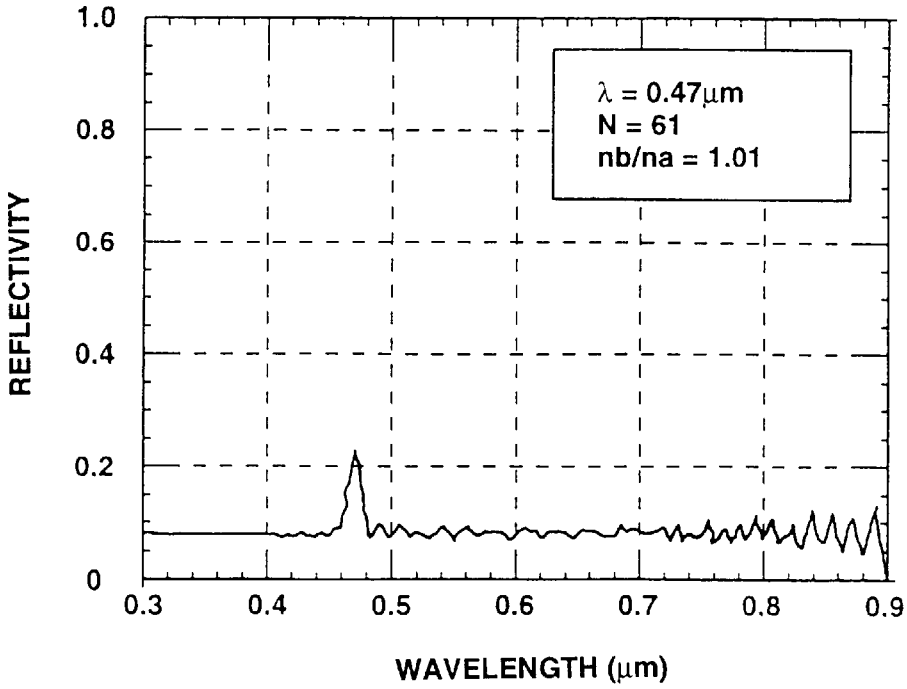
Figure 9:
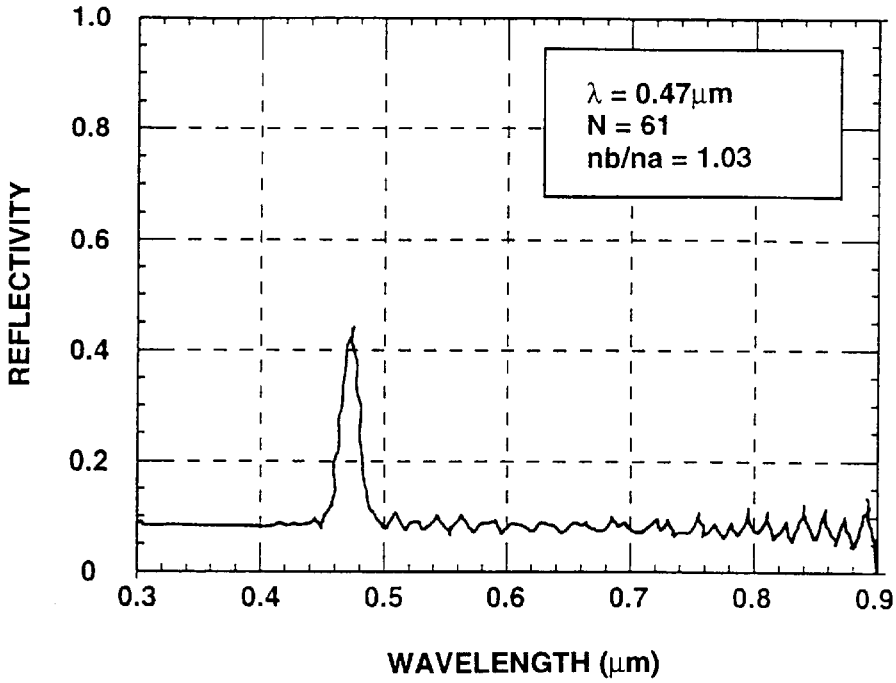
Figure 10:
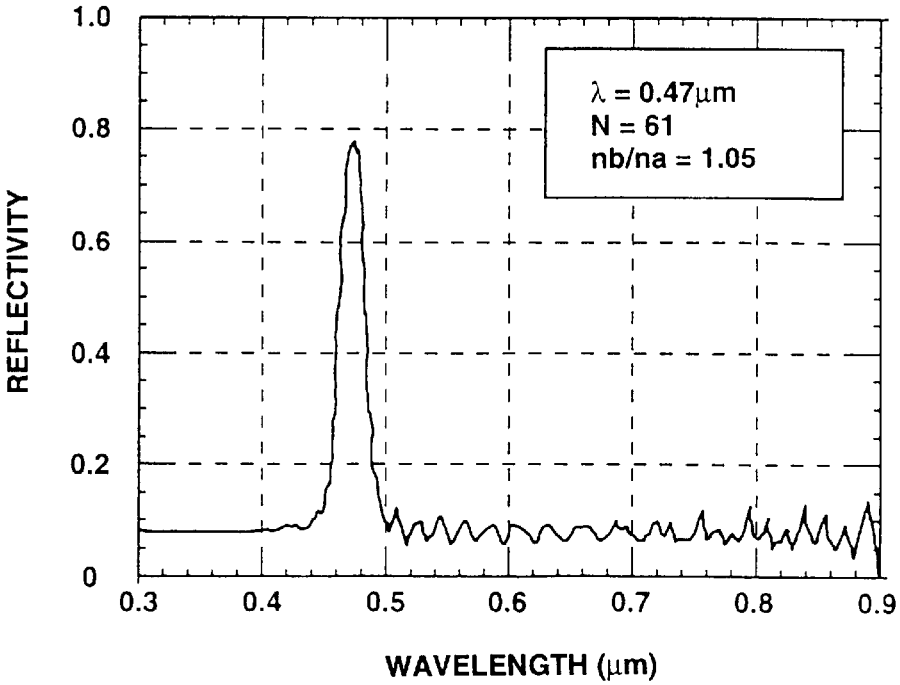
Figure 11:
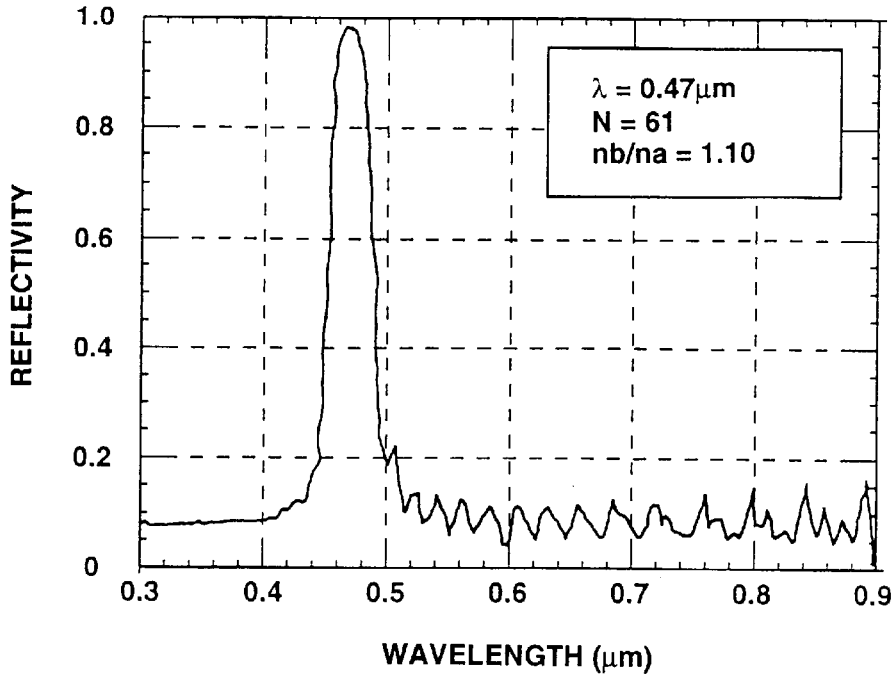
Figure 12:
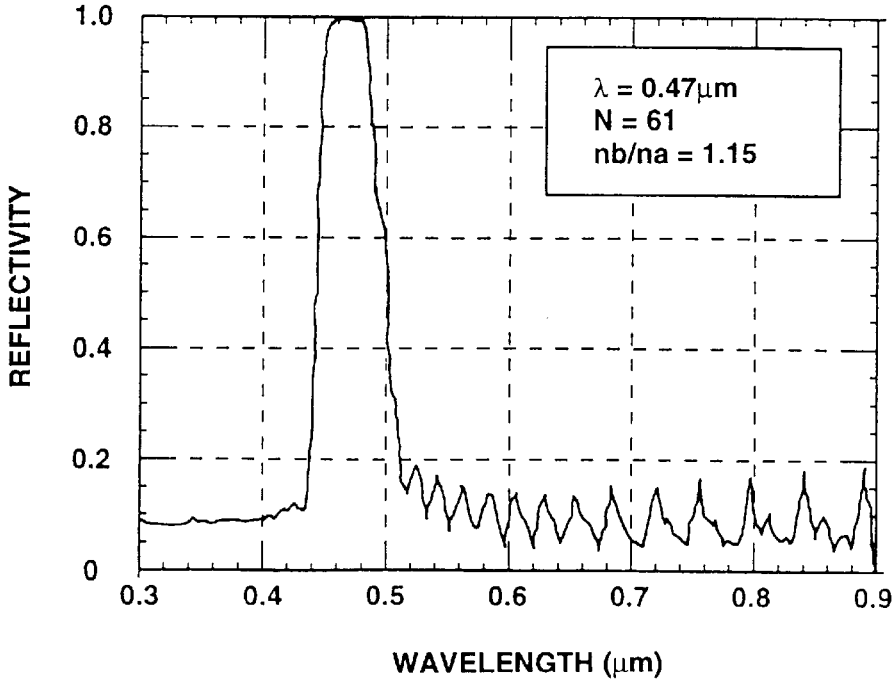
Figure 13:
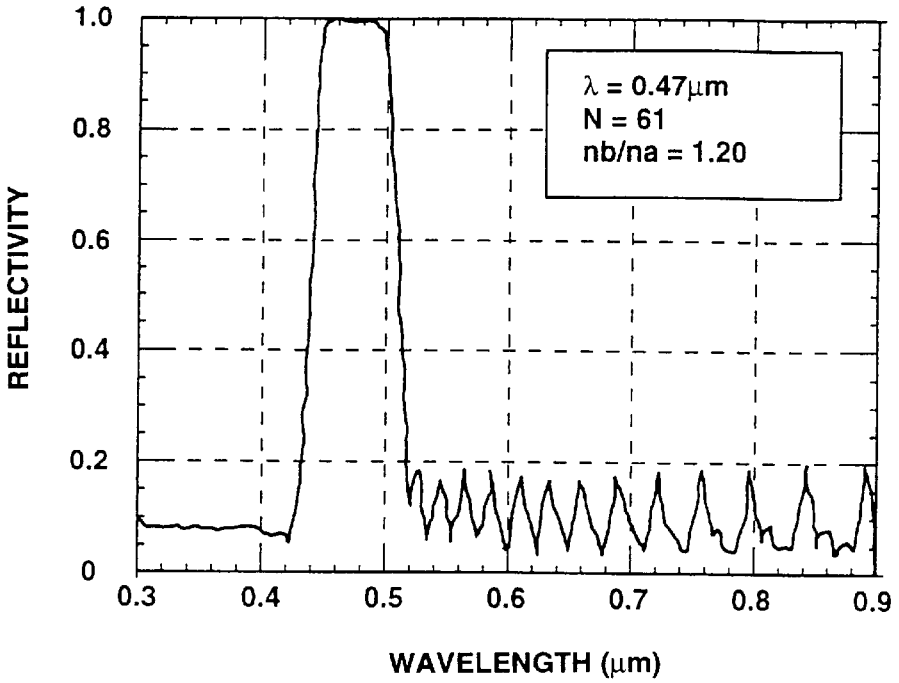
Figure 14:
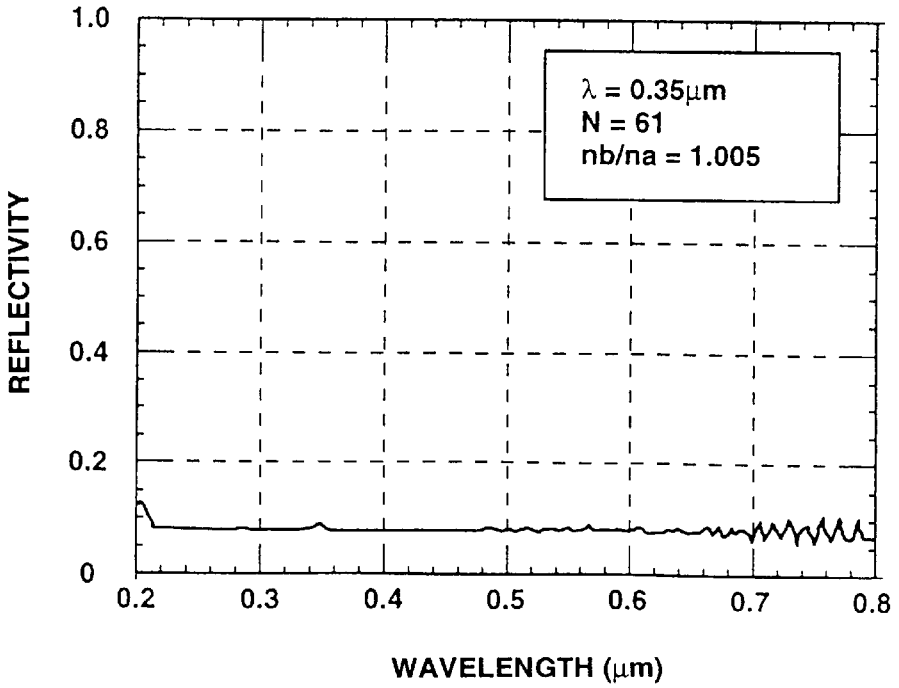
FIGS. 14–20 are views similar to FIG. 13, showing a second embodiment of the present invention.
Figure 15:
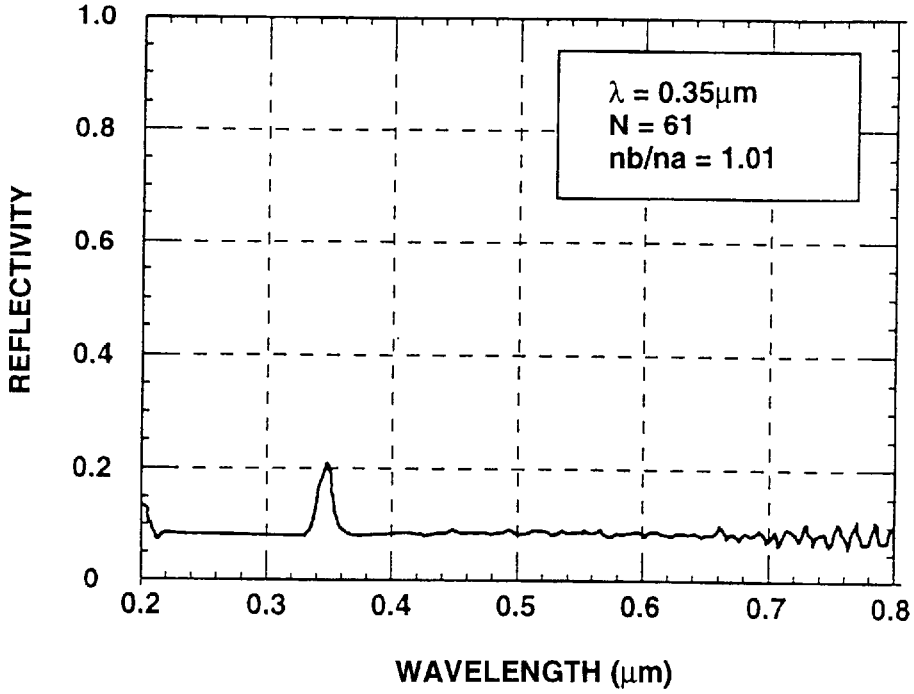

As seen from FIG. 7, even with the number N of laminations of 61, when the refractive-index ratio nb/na is 1.01 or less, the reflection spectrum has no distinct peak. Referring to FIG. 8, when the refractive-index ratio nb/na is 1.01, the reflection spectrum has a distinct peak with the reflectivity of about 0.2. Referring to FIG. 9, when the refractive-index ratio nb/na is 1.03, the reflectivity is about 0.45. Note that with relatively many combinations of two organic polymers, nb/na is in the vicinity of 1.03 as seen from FIG. 6.

As described above in connection with FIG. 6, when the refractive-index ratio nb/na is 1.01, a difference between a peak value of the reflectivity and the background, i.e. the reflectivity difference ΔR so called, is about 0.1 as seen from FIG. 8. The relative reflectivity obtained by conversion of this value is about 0.20–0.25, which corresponds to a lower limit for enabling visual recognition. Note that the above conversion can be achieved only by multiplying the value by 2.0–2.5.

As disclosed in U.S. Pat. No. 5,472,798, when determining the condition given by 1.01≦nb/na≦1.20, there remains a disadvantage that achievement of a fiber structure having a desired reflectivity requires increased number N of laminations since the refractive-index ratio nb/na is small. However, as described above in connection with FIG. 6, even with increased number N of laminations, a fiber structure can be manufactured with uniform and stable thickness of the first and second organic polymer layers 101, 102. That is, selection of a combination of two organic polymers having the forming-temperature difference ΔT of 80–70° C. or less and the refractive-index ratio nb/na given by 1.01≦nb/na≦1.20 enables achievement of a fiber structure having optical reflection and interference.

Further, as seen from FIG. 6, there are abundant varieties of combination of the first and second organic polymers 101, 102, resulting in possible achievement of a fiber structure having not only optical reflection and interference, but improved practical properties, i.e. mechanical characteristics as tensile strength and ductility and wear characteristic, in accordance with the purpose. Furthermore, there is no need to use a special organic polymer having, e.g. ultralow refractive index such as fluororesin, resulting in possible achievement of a fiber structure at a low manufacturing cost. Note that as disclosed in U.S. Pat. No. 5,472,798, the fiber structure according to the present invention can be put in chips by freeing and crushing.

FIGS. 14–20 show a second embodiment of the present invention which is substantially the same as the first embodiment. In the second embodiment, with a fiber structure as shown in FIG. 3A, the reflection spectrum in the ultraviolet region is given by varying the refractive-index ratio nb/na of two organic polymers from 1.005 to 1.20. Here, the number N of laminations of the first and second organic polymer layers 101, 102 is 61, and the protective layer 103 has a refractive index of 1.53 and a thickness of 5 μm. The reflection peak wavelength λ is 0.35 μm. Radiation is incident on the fiber structure vertically, i.e. at the incident angle of 0° and the receiving angle of 0°. Note that the wavelength of 0.35 μm, which corresponds approximately to a central value of near ultraviolet radiation called UV-A wave, is considered to have a higher risk of production of spots or freckles on the skin.

Figure 16:
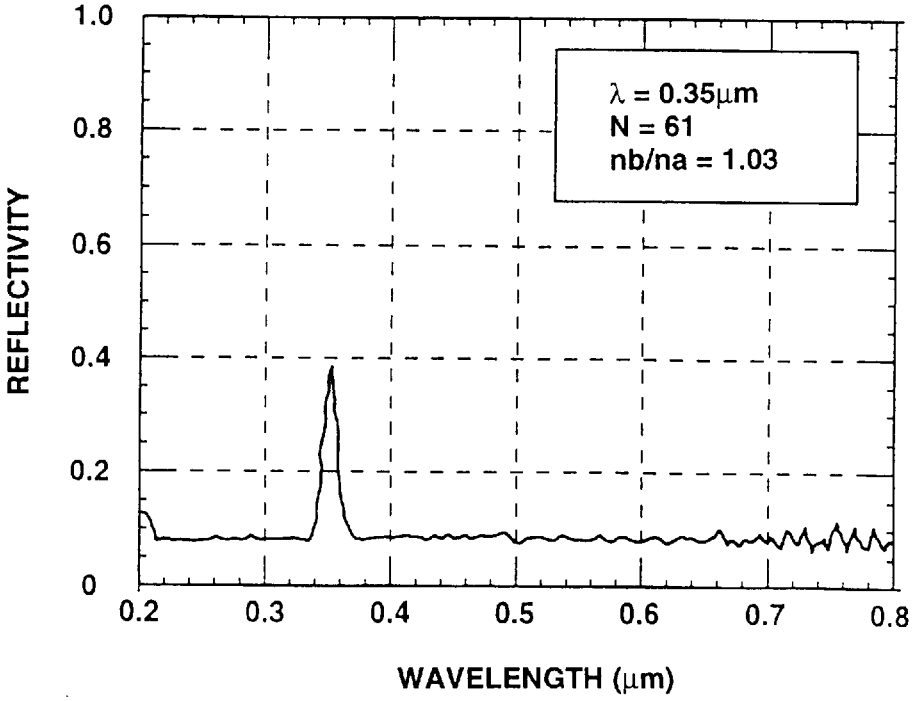
Figure 17:
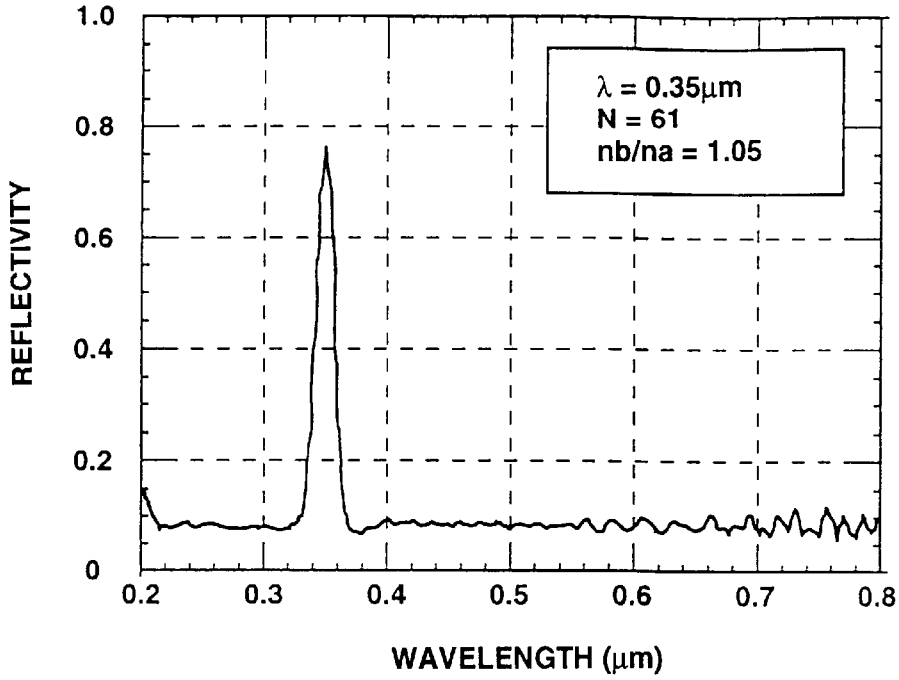
Figure 18:
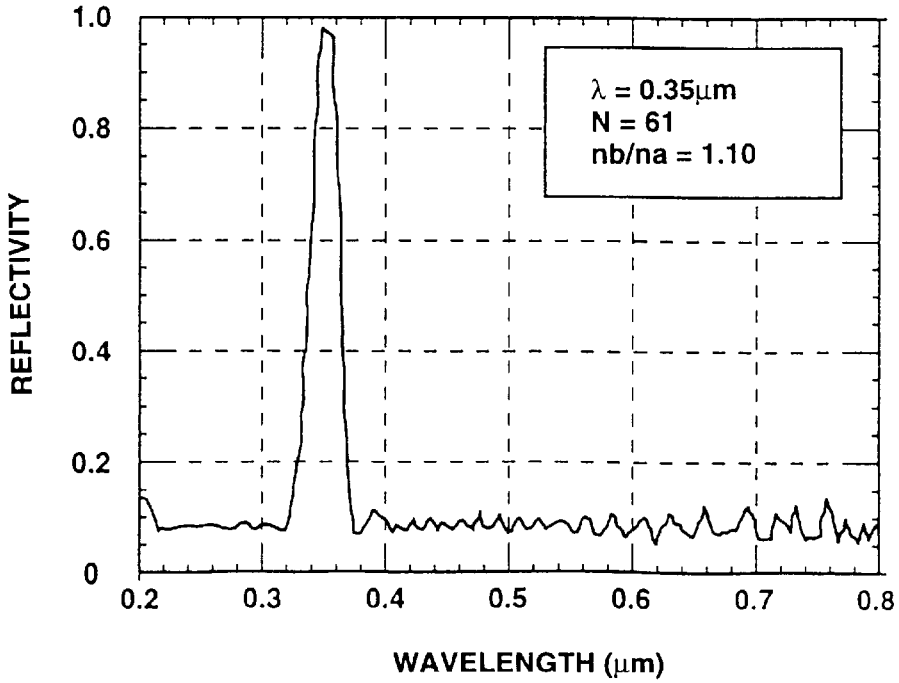
Figure 19:
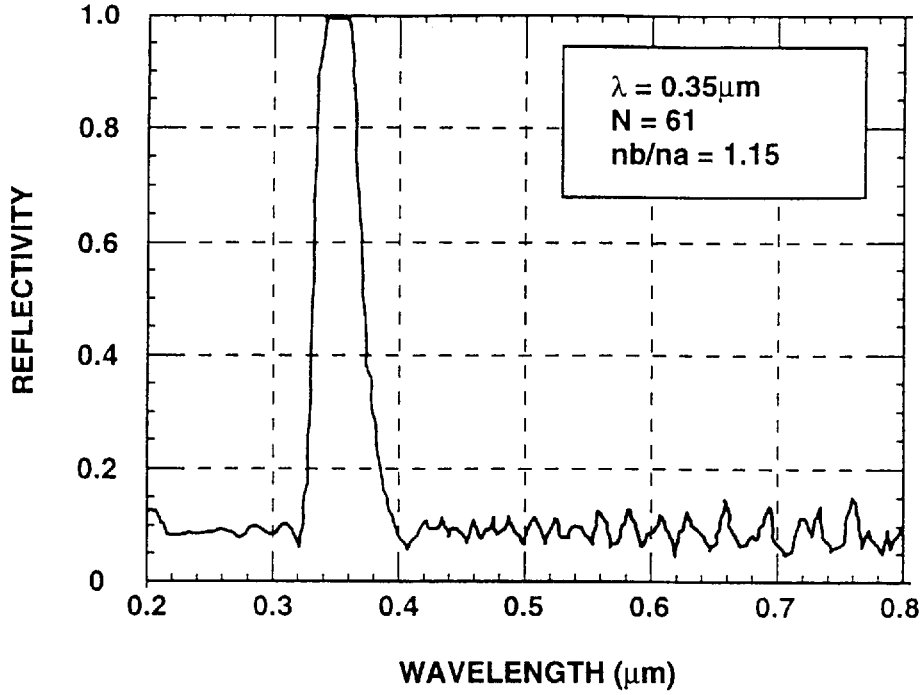
Figure 20:
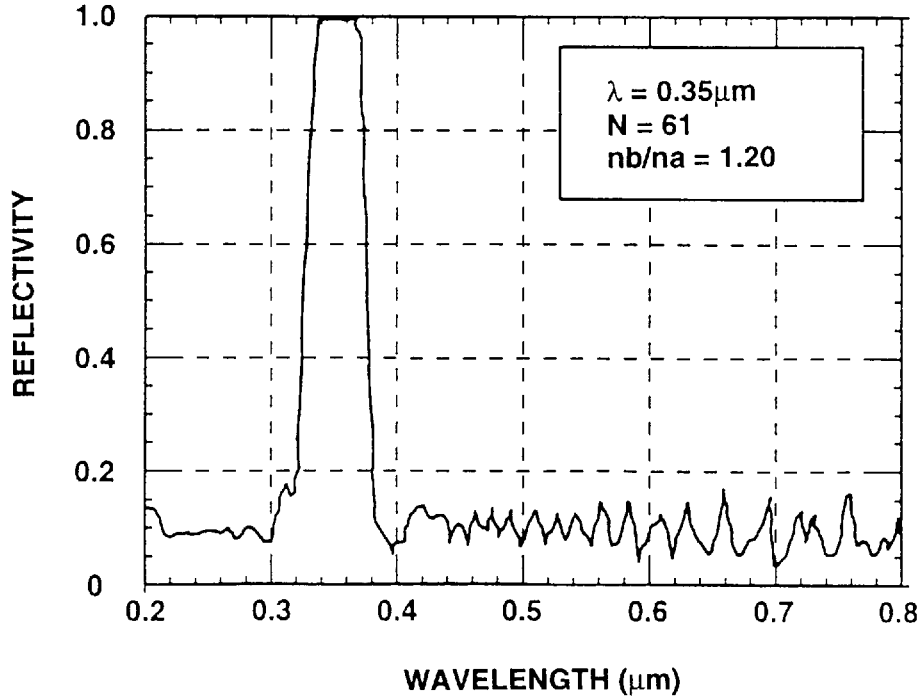
Figure 21:
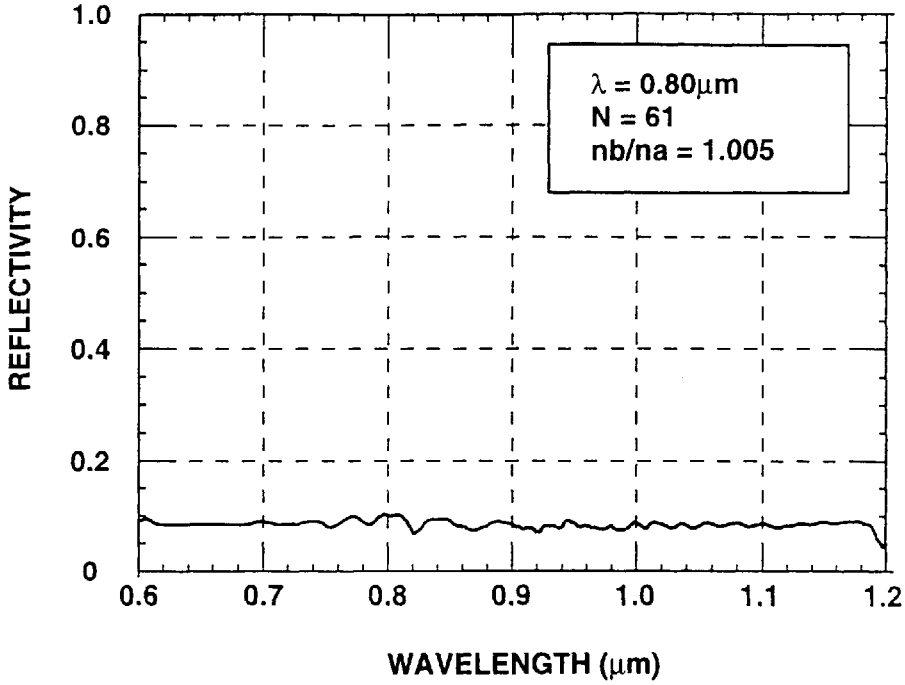
FIGS. 21–27 are views similar to FIG. 20, showing a third embodiment of the present invention.
Figure 22:
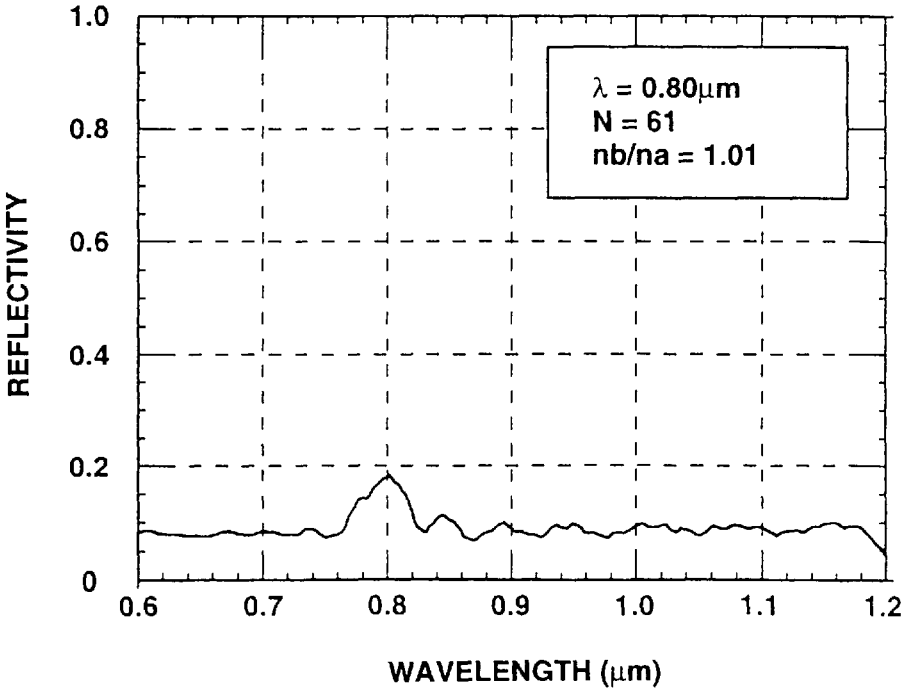

As seen from a comparison of FIGS. 14 and 15–20, when the refractive-index ratio nb/na is 1.01 or more, the reflection spectrum has a distinct peak in the same way as the reflection spectrum in the visible region. Referring to FIG. 16, when the refractive-index ratio nb/na is 1.03 (as described above, with relatively many combinations of two organic polymers, nb/na is in the vicinity of 1.03), the reflectivity is about 0.38 with the wavelength of 0.35 μm. Referring to FIGS. 17–20, with an increase in the refractive-index ratio nb/na, the reflectivity is increased. And the reflectivity at a reflection peak and a certain wavelength reaches 1.0, the half-value width of the reflection spectrum is increased, enabling reflection of ultraviolet radiation in wider wavelength range. In such a way, a fiber structure can be achieved having reflection of ultraviolet radiation with the wavelength optionally set. This function is stably ensured during a long period of time due to no use of dyes and pigments.

FIGS. 21–27 show a third embodiment of the present invention which is substantially the same as the first and second embodiments. In the third embodiment, with a fiber structure as shown in FIG. 3A, the reflection spectrum in the near infrared region is given by varying the refractive-index ratio nb/na of two organic polymers from 1.005 to 1.20. The conditions are the same as in the first and second embodiments except the reflection peak wavelength λ is 0.80 μm.

Figure 23:
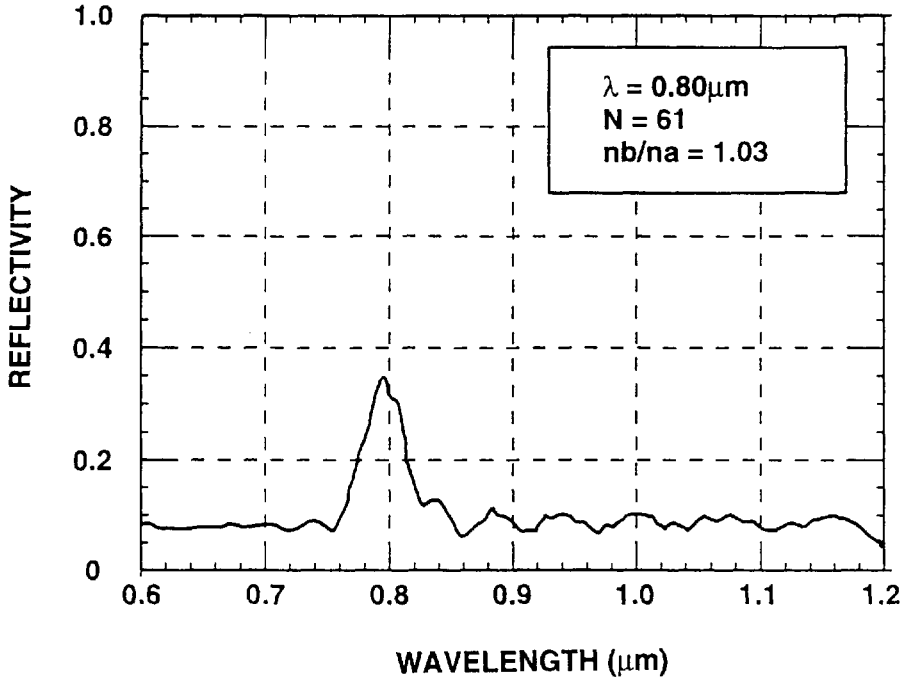
Figure 24:
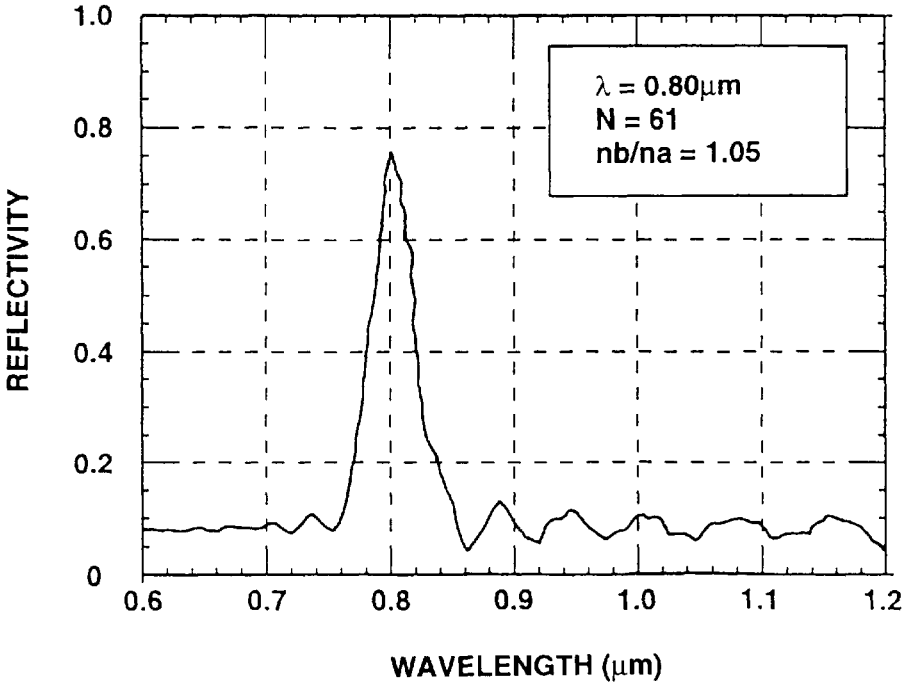
Figure 25:
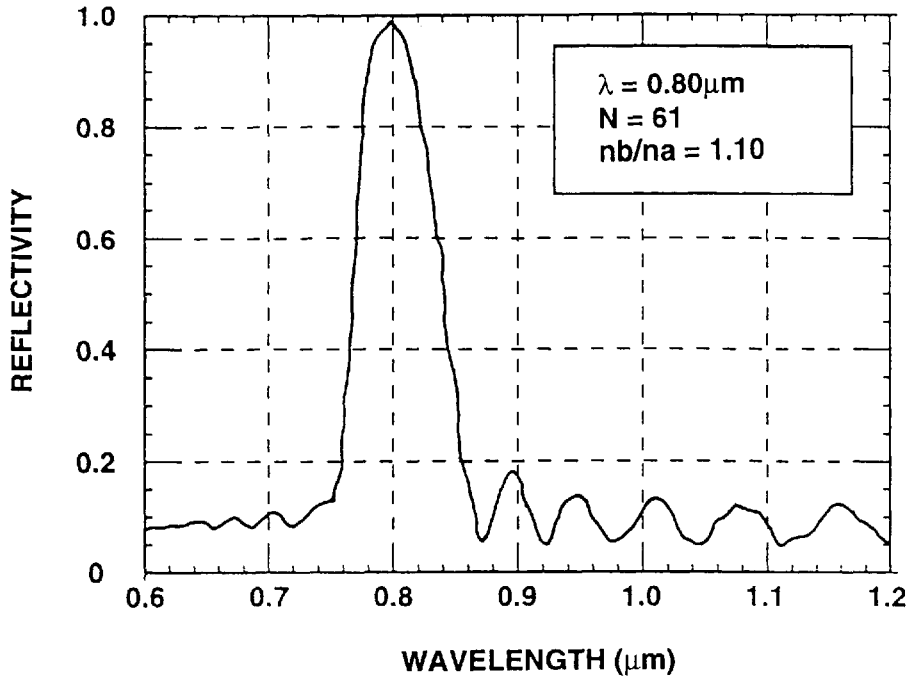
Figure 26:
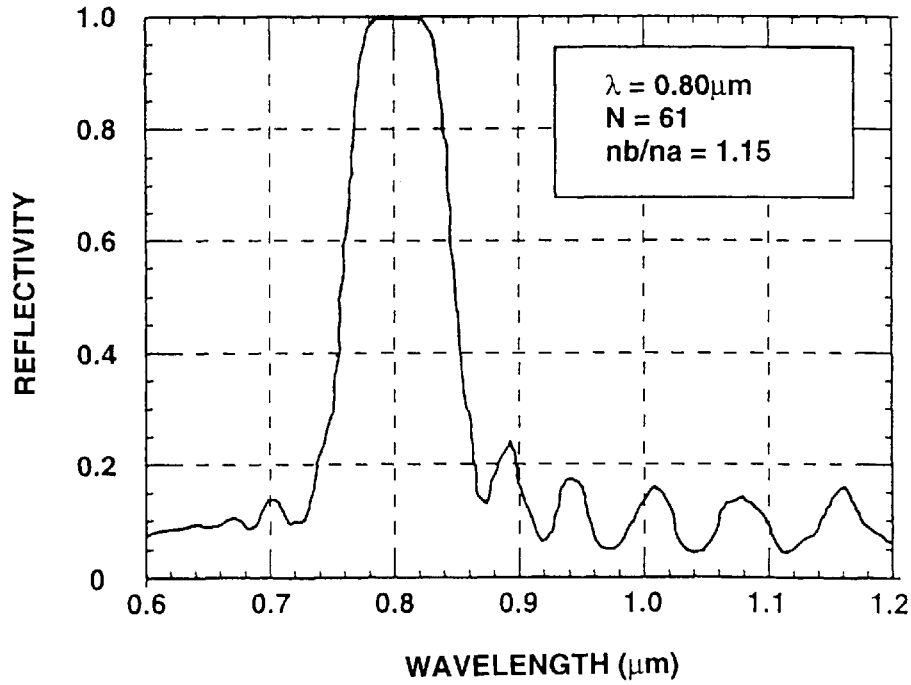
Figure 27:
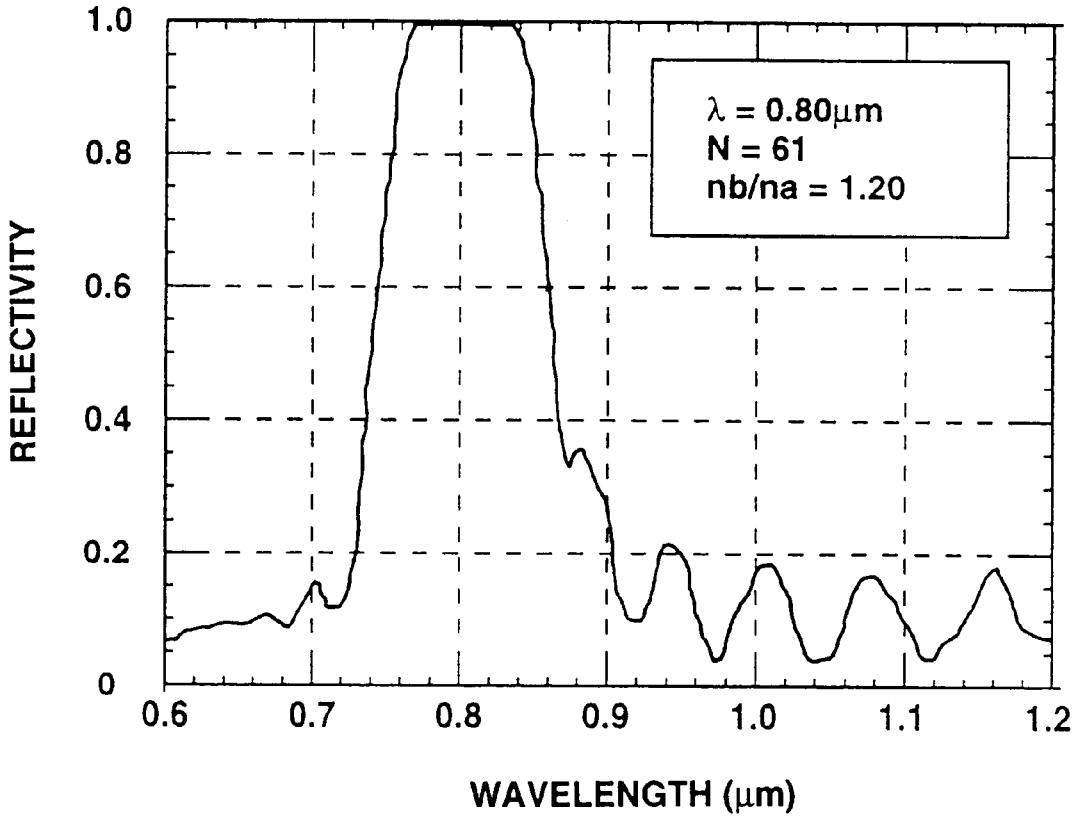

As seen from a comparison of FIGS. 21 and 22–27, when the refractive-index ratio nb/na is 1.01 or more, the reflection spectrum has a distinct peak in the visible region. Referring to FIG. 23, when the refractive-index ratio nb/na is 1.03 (as described above, with relatively many combinations of two organic polymers, nb/na is in the vicinity of 1.03), the reflectivity is about 0.35 with the wavelength of 0.85 μm. Referring to FIGS. 24–27, with an increase in the refractive-index ratio nb/na, the reflectivity is increased. And the reflectivity at a reflection peak and a certain wavelength reaches 1.01, the half-value width of the reflection spectrum is increased, enabling reflection of near infrared radiation in wider wavelength range.

In such a way, a fiber structure can be achieved having coolness and comfortableness by intercepting and shutting out near infrared radiation, i.e. heat ray. Not only this function is stably ensured during a long period of time, but no damage such as allergy to the skin is produced due to no use of dyes/pigments or metals.

Referring to FIGS. 28–31, a description will be made with regard to examples of a fiber structure for producing a color by reflecting and interfering visible radiation.

Figure 28:
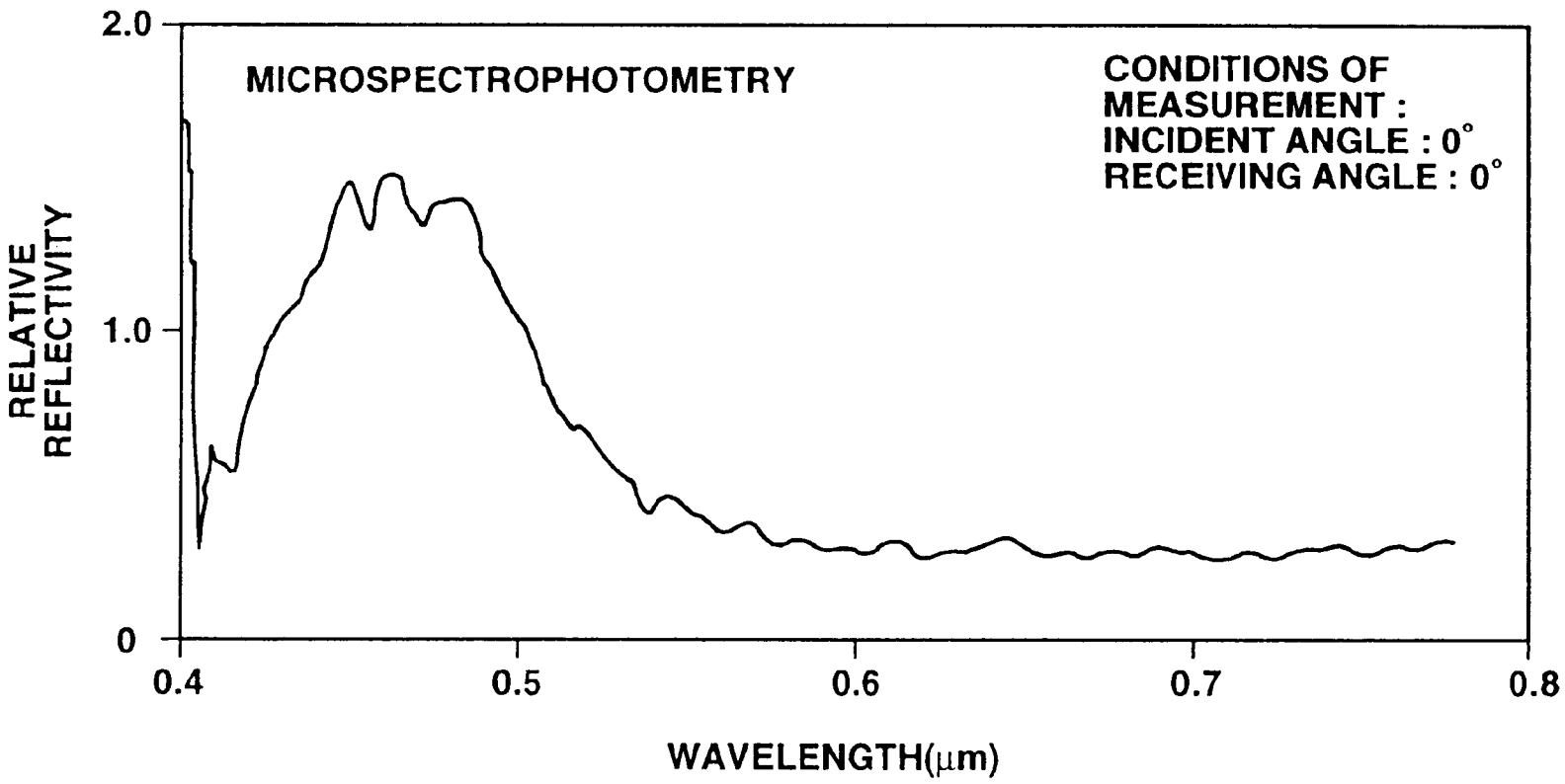
FIG. 28 is a view similar to FIG. 27, showing example 1 of the fiber structure.

Referring to FIG. 28, example 1 will be described wherein a fiber structure has a flat section as shown in FIG. 3A, and includes as the first organic polymer nylon-6 (Ny-6), and as the second organic polymer polyethylene naphthalate having 1.5 mole % of sodium sulfoisophthalate copolymerized (copolymerized PEN). The protective layer 103 includes copolymerized PEN. A color to be achieved is blue having the reflection peak wavelength λ of 0.47 μm. The average refractive index na of Ny-6 is 1.53, and the average refractive index nb of copolymerized PEN is 1.63. Thus, the refractive-index ratio nb/na of the two is 1.07.

Using a spinneret as disclosed in Japanese Patent Application P9-133039, composite melt spinning is carried out at a spinning temperature of 274° C. and a take-up speed of 1,200 m/min. to obtain a unstretched thread with the number N of laminations of 61. Then, heat stretching is carried out by a roller stretching machine at a temperature of 140° C. and a take-up speed of 300 m/min. to obtain a desired fiber structure.

Coloring and reflection spectrum of the obtained fiber structure are evaluated by a microspectrophotometer Model U-6000 manufactured by Hitachi, Ltd. Using as a reference a standard white board, the reflection spectrum is measured at an incident angle of 0° and a receiving angle of 0°. The results of evaluation are such that the fiber structure produces a color of transparent blue, and has an anisotropic characteristic that color tone varies with the point of view. Regarding the reflection spectrum, referring to FIG. 28, the reflection peak wavelength λ is 0.47 μm, and the relative reflectivity is 1.2.

Figure 29:
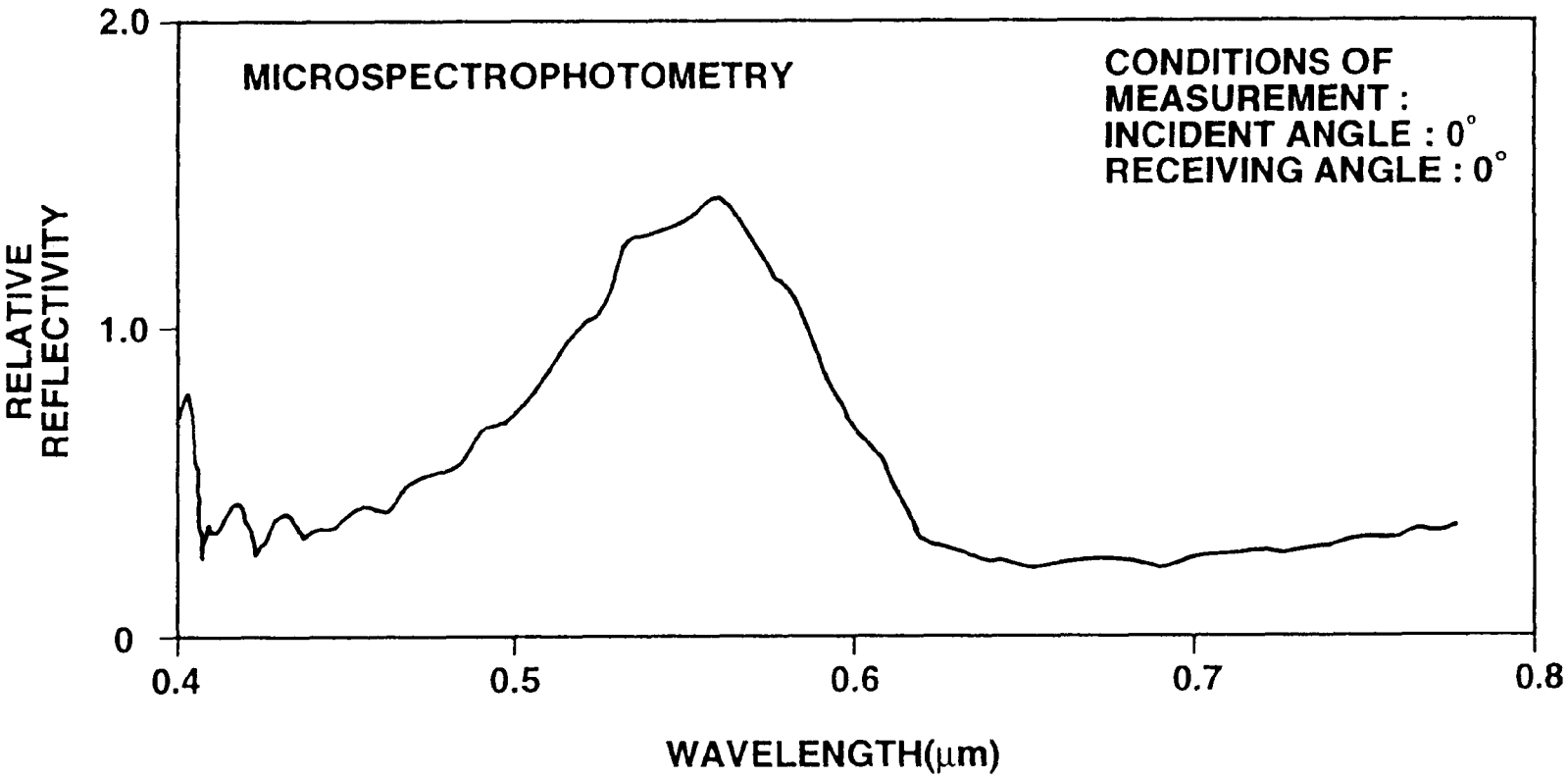
FIG. 29 is a view similar to FIG. 28, showing example 2 of the fiber structure.

Referring to FIG. 29, example 2 will be described wherein a fiber structure has a flat section as shown in FIG. 3A, and includes as the first organic polymer polymethyl methacrylate (PMMA) (MF manufactured by Mitsubishi Rayon Co. Ltd.), and as the second organic polymer polycarbonate (PC) (AD-5503 manufactured by TEIJIN LTD.). The protective layer 103 includes PC. A color to be achieved is green having the reflection peak wavelength λ of 0.55 μm. The average refractive index na of PMMA is 1.49, and the average refractive index nb of PC is 1.59. Thus, the refractive-index ratio nb/na of the two is 1.07.

Using a spinneret as disclosed in Japanese Patent Application P9-133039, composite melt spinning is carried out at a spinning temperature of 278° C. and a take-up speed of 1,200 m/min. to obtain a unstretched thread with the number N of laminations of 61. Then, heat stretching is carried out by a roller stretching machine at a temperature of 140° C. and a take-up speed of 300 m/min. to obtain a desired fiber structure.

Coloring and reflection spectrum of the obtained fiber structure are evaluated by a microspectrophotometer Model U-6000 manufactured by Hitachi, Ltd. Using as a reference a standard white board, the reflection spectrum is measured at an incident angle of 0° and a receiving angle of 0°. The results of evaluation are such that the fiber structure produces a color of transparent green, and has an anisotropic characteristic that color tone varies with the point of view. Regarding the reflection spectrum, referring to FIG. 29, the reflection peak wavelength A is 0.56 μm, and the relative reflectivity is 1.5.

Figure 30:
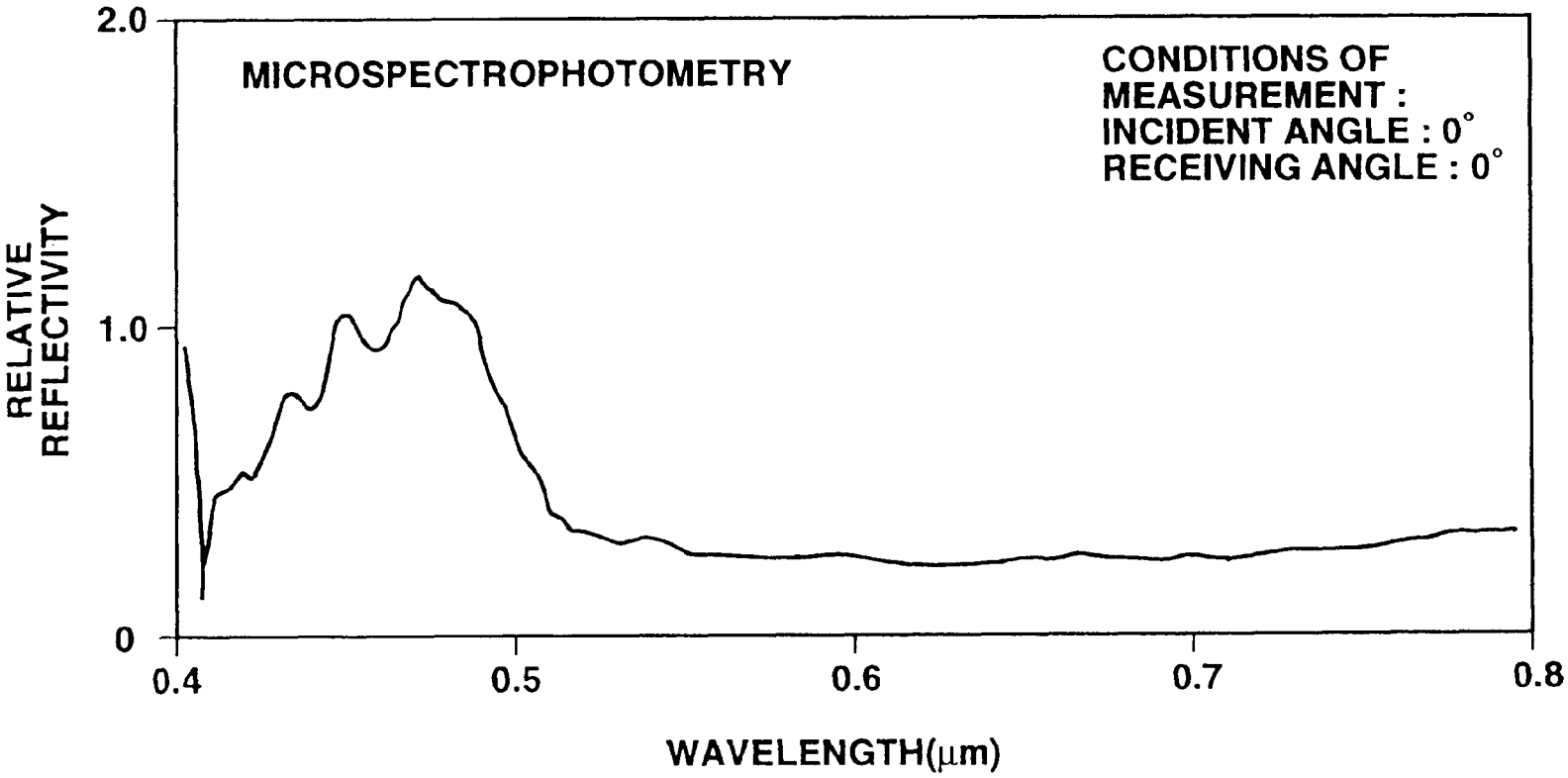
FIG. 30 is a view similar to FIG. 29, showing example 3 of the fiber structure.

Referring to FIG. 30, example 3 will be described wherein a fiber structure has a flat section as shown in FIG. 3A, and includes as the first organic polymer Ny-6, and as the second organic polymer polyethylene terephthalate having 0.6 mole % of sodium sulfoisophthalate copolymerized (copolymerized PET) The protective layer 103 includes copolymerized PET. A color to be achieved is blue having the reflection peak wavelength λ of 0.47 μm. The average refractive index na of Ny-6 is 1.53, and the average refractive index nb of copolymerized PET is 1.58. Thus, the refractive-index ratio nb/na of the two is 1.03.

Using a spinneret as disclosed in Japanese Patent Application P9-133039, composite melt spinning is carried out at a spinning temperature of 274° C. and a take-up speed of 1,200 m/min. to obtain a unstretched thread with the number N of laminations of 61. Then, heat stretching is carried out by a roller stretching machine at a temperature of 90° C. and a take-up speed of 300 m/min. to obtain a desired fiber structure.

Coloring and reflection spectrum of the obtained fiber structure are evaluated by a microspectrophotometer Model U-6000 manufactured by Hitachi, Ltd. Using as a reference a standard white board, the reflection spectrum is measured at an incident angle of 0° and a receiving angle of 0°. The results of evaluation are such that the fiber structure produces a color of transparent blue, and has an anisotropic characteristic that color tone varies with the point of view. Regarding the reflection spectrum, referring to FIG. 30, the reflection peak wavelength λ is 0.47 μm, and the relative reflectivity is 1.1.

Figure 31:
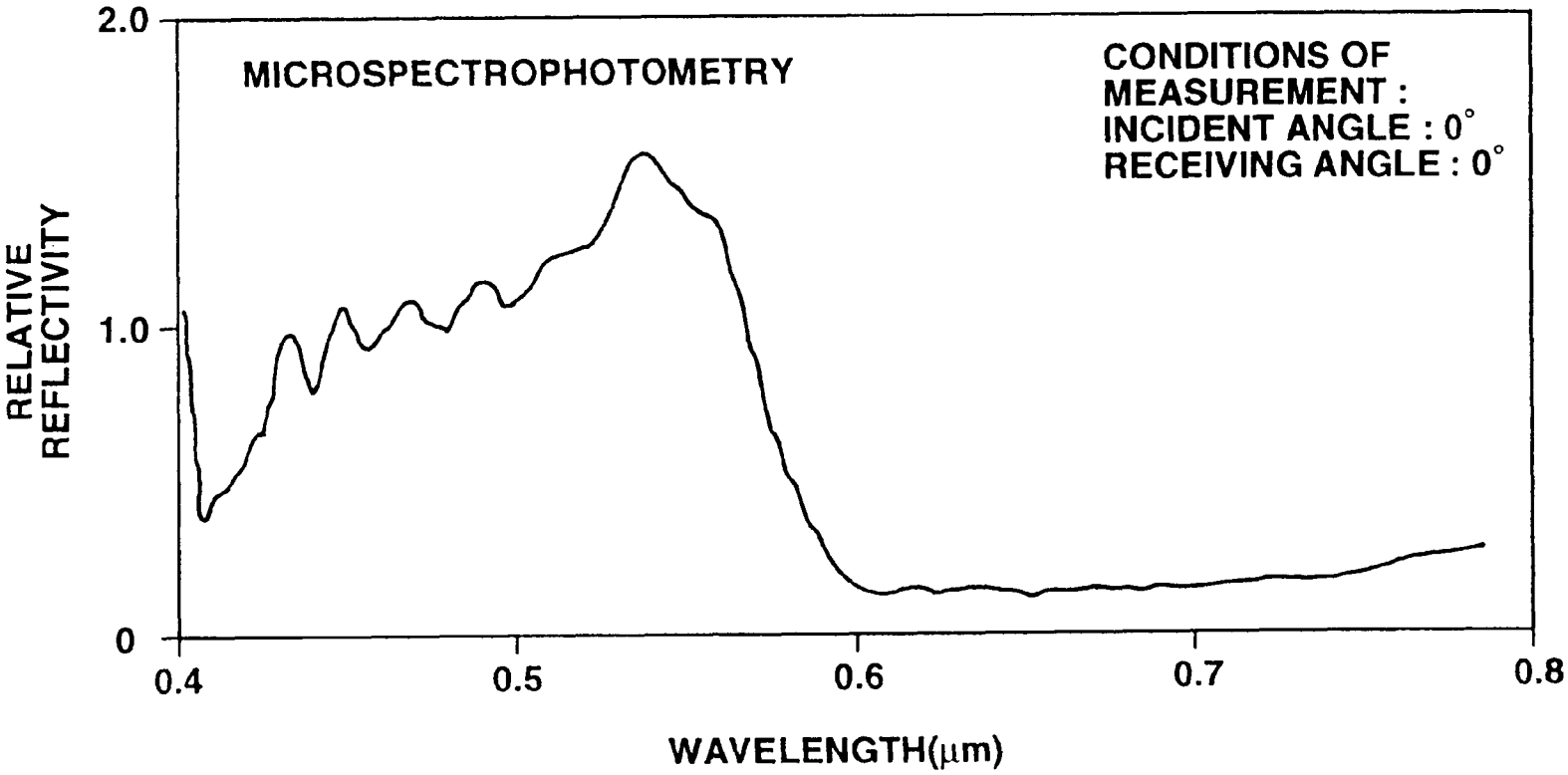
FIG. 31 is a view similar to FIG. 30, showing example 3 of the fiber structure.

Referring to FIG. 31, example 4 will be described wherein a fiber structure has a flat section as shown in FIG. 3A, and includes as the first organic polymer polyvinylidene fluoride (PVDF), and as the second organic polymer polyethylene terephthalate (PET). The protective layer 103 includes PET. A color to be achieved is green having the reflection peak wavelength λ of 0.52 μm. The average refractive index na of PVDF is 1.42, and the average refractive index nb of PET is 1.58. Thus, the refractive-index ratio nb/na of the two is 1.11.

Using a spinneret as disclosed in Japanese Patent Application P9-133039, composite melt spinning is carried out at a spinning temperature of 274° C. and a take-up speed of 1,200 m/min. to obtain a unstretched thread with the number N of laminations of 61. Then, heat stretching is carried out by a roller stretching machine at a temperature of 90° C. and a take-up speed of 300 m/min. to obtain a desired fiber structure.

Coloring and reflection spectrum of the obtained fiber structure are evaluated by a microspectrophotometer Model U-6000 manufactured by Hitachi, Ltd. Using as a reference a standard white board, the reflection spectrum is measured at an incident angle of 0° and a receiving angle of 0°. The results of evaluation are such that the fiber structure produces a color of transparent green, and has an anisotropic characteristic that color tone varies with the point of view. Regarding the reflection spectrum, referring to FIG. 31, the reflection peak wavelength $\lambda$ is 0.53 $\mu$m, and the relative reflectivity is 1.7.

FIGS. 32–35 show a fourth embodiment of the present invention wherein a textile includes a fiber structure for producing a color by reflecting and interfering visible radiation. The fiber structure includes in a cross section alternate lamination of two or more polymers different refractive index. The fiber structure may include a protective layer for covering the entirety of alternate lamination. The fiber structure, which is fundamentally semitransparent or transparent, produces a color due to reflection and interference of visible radiation, and not due to the use of dyes and pigments.

Figure 32:
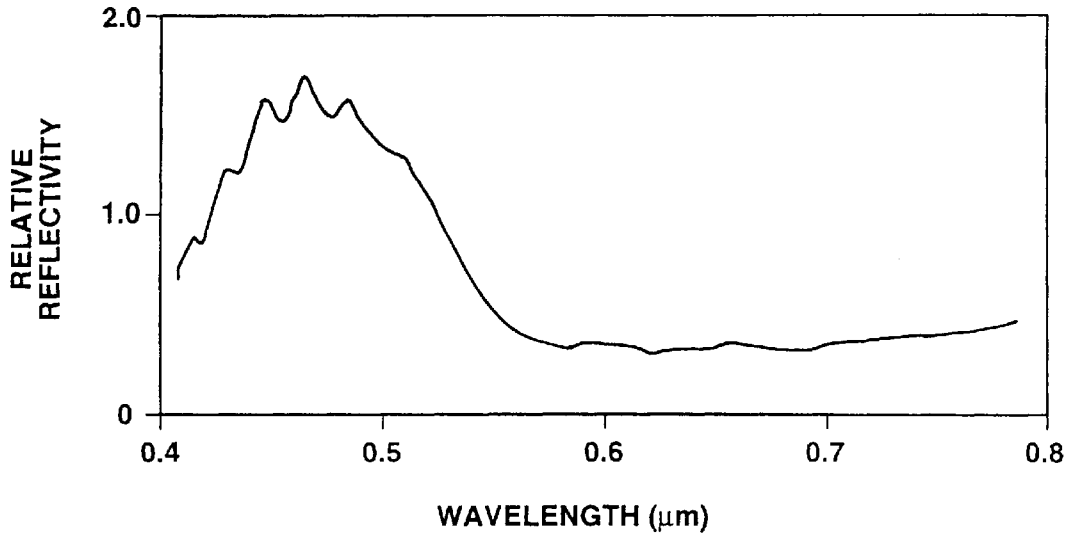
FIGS. 32–33 are views similar to FIG. 31, showing a fourth embodiment of the present invention.

FIG. 32 shows a reflection spectrum of an 8 denier fiber structure including an optical interference portion having 61 layers of polyester and polyamide alternately laminated, and a shell portion of polyester. The incident angle is 0°, and the receiving angle is 0°. Regarding the reflection spectrum of an ordinary object color, the reflectivity cannot exceed 100% in any color range with respect to a standard white board. On the other hand, regarding the fiber structure, the reflectivity greatly exceeds 100% in a predetermined wavelength band as shown in FIG. 32, increasing the brightness, resulting in increased apparent chroma.

Moreover, in view of the optical physical principle, the fiber structure has not only a coloring characteristic that a color produces by interference of visible radiation, but an anisotropic reflection characteristic that color tone varies with the point of view, having no color turbidity. An interference color is completely different from an ordinary object color, having a feature of difficult settlement of a fixed point of view and induction of fluorescent feel.

When there exist a structure having optical reflection and interference on the side of incident radiation, and a structure on the inside adjacent thereto for absorbing radiation except radiation with a predetermined reflection/interference wavelength (in this case, stray light occurs), coloring due to reflection and interference of radiation is perceived more brightly. That is, when combining the fiber structure having both coloring characteristic and anisotropic reflection characteristic, and a fiber such as natural fiber including wool, hemp, cotton and silk, or recycled fiber thereof, or chemical fiber including semisynthetic fiber and synthetic fiber, or mixed fiber thereof, a textile is obtained with diversified anisotropic brightness and clearness and excellent feeling.

Figure 33:
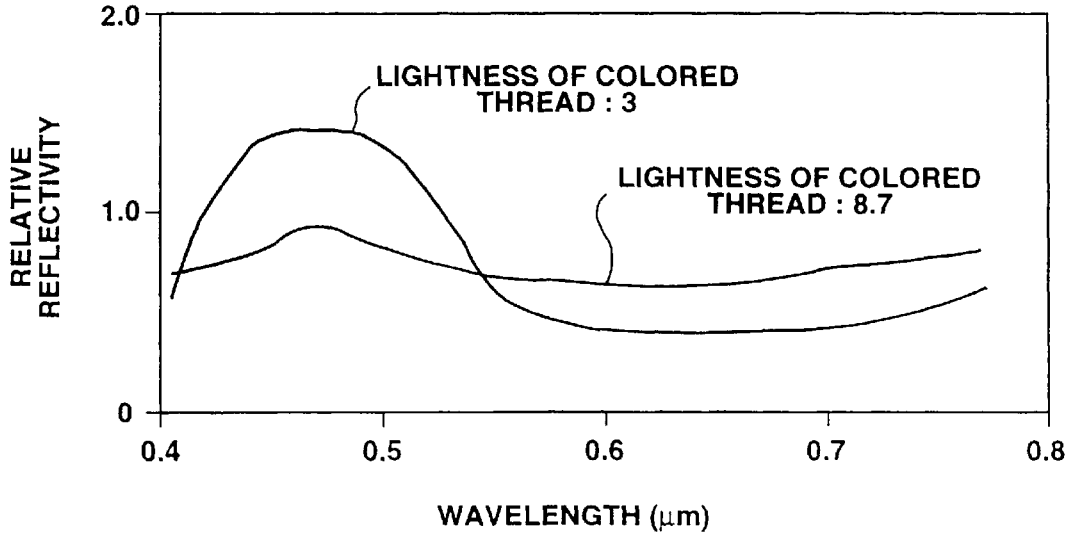

FIG. 33 shows a reflection spectrum of a fiber structure in a plain weave cloth including a combination of a fiber-structure thread and an ordinary colored thread with respect to the lightness of the colored thread. The incident angle is 0°, and the receiving angle is 0°. When the lightness of the colored thread combined with the fiber structure is 8.7 or less in the Munsell color system, a color of the fiber structure is perceived in the entirety of the reflection spectrum without difficulty, and it is clearer as the lightness of the periphery of the fiber structure is smaller.

Regarding a textile including a combination of two different fiber-structure threads or a combination of a fiber-structure thread and a white fiber thread, part of radiation with a predetermined interference wavelength and the entirety of radiation with other wavelengths pass through the textile, and part of those radiations remains therein as stray light, giving visual quality having a pale color featured by difficult settlement of a fixed point of view.

Figure 34:
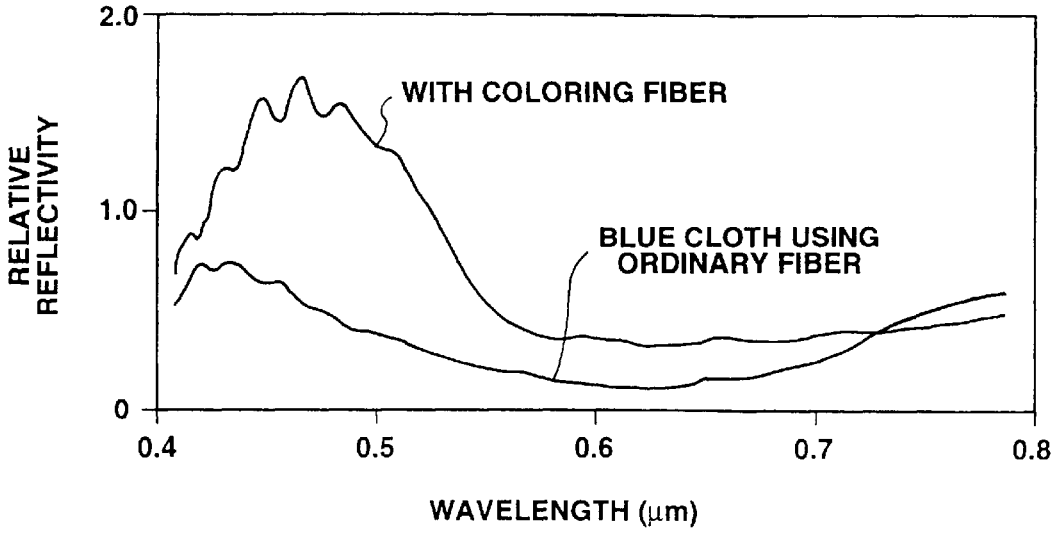
FIGS. 34–35 are views similar to FIG. 33, showing examples 1–3 of a textile including the fiber structure.
Figure 35:
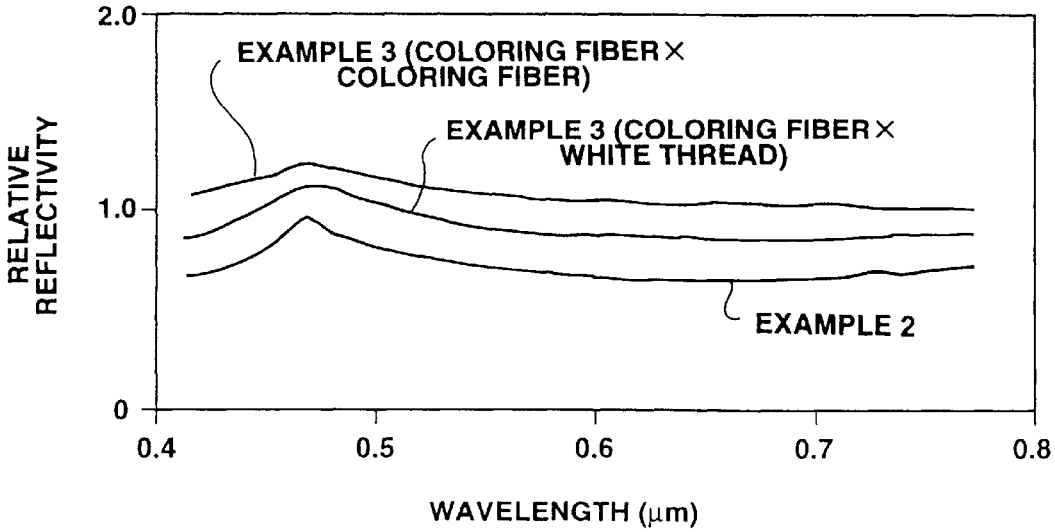

Referring to FIGS. 34–35, a description will be made with regard to examples of a textile including a fiber structure for producing a color by reflecting and interfering visible radiation.

Referring to FIG. 34, example 1 will be described wherein an ordinary plain satin weave textile includes a 66–132 denier warp including eleven 6–12 denier fiber structures, each including a shell portion of polyester and a coloring portion having alternate lamination of polyester and polyamide and designed to have the reflection/interference wavelength in the vicinity of 0.47 $\mu$m, and a weft including a black solution-dyed thread having substantially the same denier and the lightness of 1–3 in the Munsell color system.

The spectrum reflectivity of the textile is measured at the incident angle of 0° and the receiving angle of 0°, which is compared with that of a vivid blue plain satin weave cloth of fine polyester having the hue of 2.5–3.5 PB, the lightness of 5–6, and the chroma of 9.

The results of comparison are as shown in FIG. 34. It is confirmed that as compared with the blue cloth of ordinary polyester fibers, the textile including as a warp the fiber structure has not only very high relative reflectivity, but a color with very intense metallic luster and clear deepness when having fiber dyeing as well as piece dyeing.

Moreover, it is confirmed that such feature and visual quality of the textile vary largely in accordance with the amount of the fiber structure, the hue, lightness and chroma (three attributes of a color in the Munsell color system) of an ordinary thread combined with the fiber structure, and the way of weaving.

Referring to FIG. 35, example 2 will be described wherein an ordinary plain weave textile includes a warp including the same fiber structure as in example 1, and a weft including a slightly dull-hued ordinary fiber thread having the hue of 5Y–5GY, the lightness of about 8.75, and the chroma of about 0.5. The reflection spectrum of the textile is measured in the same way as in example 1. The results of measurement are as shown in FIG. 35.

In example 2, due to increased white component, a transmitted component is increased actually. However, measurement of the reflection spectrum reveals that a reflected component is increased to increase luster of the entirety of the textile. Moreover, visual observation reveals that color dullness of the ordinary fiber thread tends to be canceled due to existence of the fiber structure, and that the textile has a color tone finely varied in accordance with the incident angle of light with respect to irregularities of the textile, which produces new visual quality.

Referring to FIG. 35, example 3 will be described wherein one textile includes a warp including the same fiber structure as that in example 1 and a weft including white or off-white ordinary fiber thread having the lightness of about 9, and another textile includes a warp and a weft, each including the same fiber structure as that in example 1. The reflection spectrum of each textile is measured in the same way as in example 1. The results of measurement are as shown in FIG. 35.

Measurement of the reflection spectrum reveals that the reflection spectrum tends to exceed the reflectivity of the standard white board in the entirety of the visible region, having increased tendency in example 2. Moreover, visual observation reveals that the textile has a color tone finely varied in accordance with the incident angle of light with respect to irregularities of the textile, and featured by difficult settlement of a fixed point of view and increased fluorescent feel, which produces new visual quality.

Example 4 will be described wherein the same fiber structure as in example 1 is linearly woven in a textile on its pattern like a loose thread to form an embroidered design, which is observed visually for comparison with the same pattern having an ordinary thread.

In example 4, the optical characteristic cannot be measured in the entirety of the textile. However, it is confirmed that with the textile including the fiber structure, the linear portion on the pattern produces metallic luster with remarkable fluorescent feel, giving visual quality as if the pattern changes.

Having described the present invention with regard to the preferred embodiments, it is noted that the present invention is not limited thereto, and various changes and modifications can be made without departing from the scope of the present invention.

INDUSTRIAL APPLICABILITY

A fiber structure is obtained which produces a color by reflecting and interfering visible radiation or reflecting ultraviolet or infrared radiation. Moreover, a textile is obtained using such fiber structure.

What is claimed is:

1. A fiber structure having at least one of the characteristics of reflection and interference of visible radiation, reflection of ultraviolet radiation, and reflection of infrared radiation, the fiber structure having a cross section with X-axis and Y-axis directions, comprising:

an alternate lamination arranged in the cross section, said alternate lamination including a predetermined number of:

a first portion having a refractive index na and a thickness da; and a second portion adjacent to said first portion, said second portion having a refractive index nb and a thickness db, wherein when said refractive index na is given by $1.3 \leqq na$, and a ratio nb/na is given by $1.01 \leqq nb/na \leqq 1.20$, a reflection peak wavelength $\lambda$ is equal to 2(nada+nbdb), and wherein a difference in forming temperature between said first and second portions is 50° C. or less.

2. A fiber structure as claimed in claim 1, wherein said ratio nb/na is given by $1.01 \leqq nb/na \leqq 1.10$.

3. A fiber structure as claimed in claim 2, wherein said ratio nb/na is given by $1.03 \leqq nb/na \leqq 1.10$.

4. A fiber structure as claimed in claim 1, wherein said predetermined number of said alternate lamination is 5 or more.

5. A fiber structure as claimed in claim 1, wherein said cross section of the fiber structure has a flat shape.

6. A fiber structure as claimed in claim 1, wherein said first and second portions are selected from the group consisting of polyester, polyamide, polyolefine and vinyl polymers; polyether ketone, polysulfide, fluoropolymer and polycarbonate; mixtures of two or more of said polymers; and copolymers thereof.

7. A fiber structure as claimed in claim 6, wherein said first portion includes nylon-6, and said second portion includes polyethylene naphthalate.

8. A fiber structure as claimed in claim 6, wherein said first portion includes polymethyl methacrylate, and said second portion includes polycarbonate.

9. A fiber structure as claimed in claim 6, wherein said first portion includes nylon-6, and said second portion includes polyethylene terephthalate.

10. A fiber structure as claimed in claim 6, wherein said first portion includes polyvinylidene fluoride, and said second portion includes polyethylene terephthalate.

* * * * *

UNITED STATES PATENT AND TRADEMARK OFFICE

CERTIFICATE OF CORRECTION

PATENT NO. : 6,326,094 B1
DATED : December 4, 2001
INVENTOR(S) : Makoto Asano et al.

It is certified that error appears in the above-identified patent and that said Letters Patent is hereby corrected as shown below:

Title page,
Item [30], please insert:
[30] Foreign Application Priority Data:

| | | |
|---|---|---|
| October 2, 1997 | (JP) | 9-270095 |
| October 17, 1997 | (JP) | 9-285776 |

Signed and Sealed this

Fourth Day of June, 2002

*Attest:*

*Attesting Officer*

JAMES E. ROGAN
*Director of the United States Patent and Trademark Office*